US010013960B1

(12) United States Patent
Wish

(10) Patent No.: US 10,013,960 B1
(45) Date of Patent: Jul. 3, 2018

(54) GO DRUM

(71) Applicant: David Wish, Montclair, NJ (US)

(72) Inventor: David Wish, Montclair, NJ (US)

( * ) Notice: Subject to any disclaimer, the term of this patent is extended or adjusted under 35 U.S.C. 154(b) by 0 days.

(21) Appl. No.: 15/430,431

(22) Filed: Feb. 10, 2017

(51) Int. Cl.
*G10D 13/02* (2006.01)
*G10D 13/00* (2006.01)
*G10D 13/06* (2006.01)

(52) U.S. Cl.
CPC ..... *G10D 13/02* (2013.01); *G10D 13/006* (2013.01); *G10D 13/025* (2013.01); *G10D 13/06* (2013.01)

(58) Field of Classification Search
CPC ..... G10D 13/006; G10D 13/025; G10D 13/06
USPC ..... 84/411 R, 412
See application file for complete search history.

(56) References Cited

U.S. PATENT DOCUMENTS 3,326,074 A * 6/1967 Osty ..... G10D 13/029 84/411 R
6,211,448 B1 * 4/2001 Shigenaga ..... G10D 13/00 84/411 R
8,927,842 B1 * 1/2015 Honjo ..... G10D 13/026 84/411 R

* cited by examiner

*Primary Examiner* — Kimberly Lockett
(74) *Attorney, Agent, or Firm* — Manatt, Phelps & Phillips LLP

(57) ABSTRACT

A compact drum kit comprising a body having a hollow interior defined by a top, a bottom, and three or more sides connecting the top and bottom, a sound hole, a plurality of component mounting shafts mounted in the hollow interior of the body and protruding through a plurality of openings in the top, a plurality of leg shafts mounted in the hollow interior of the body and protruding through a plurality of openings in the bottom, one or more percussion modules that attach to one or more of the plurality of component mounting shafts, wherein each percussion module produces a sound in response to being struck or scraped, and a kick pedal including a beater positioned to strike a first side of the three or more sides and produce a sound.

6 Claims, 27 Drawing Sheets

GO DRUM

TECHNICAL FIELD

This disclosure relates generally to musical instruments and more specifically relates to a drum set.

BACKGROUND

A drum kit, drum set, trap set, or just drums is a collection of drums and other percussion instruments set up to be played/struck by a single player. The traditional drum kit consists of a mix of drums (classified as classically as membranophones, Hornbostel-Sachs high-level classification 2) and idiophones (Hornbostel-Sachs high-level classification 1, most significantly cymbals but also including the woodblock and cowbell for example). More recently kits have also included electronic instruments (Hornbostel-Sachs classification 53), with both hybrid and entirely electronic kits now in common use.

A standard modern kit (for a right-handed player), as used in popular music and taught in many music schools, contains: A snare drum, mounted on a stand, placed between the player's knees and played with drum sticks (which may include rutes or brushes); a bass drum, played by a pedal operated by the right foot; and one or more cymbals, played with the sticks.

All of these are classed as non-pitched percussion, allowing for the music to be scored using percussion notation, for which a loose semi-standardized form exists for the drum kit. If some or all of them are replaced by electronic drums, the scoring and most often positioning remains the same, allowing a standard teaching approach. The drum kit is usually played seated on a drum stool or throne. The drum kit differs in general from those traditional instruments that produce melody or chords/pitch per se: even though drums are often placed musically alongside others that do, such as the piano or stringed instruments.

Many drummers extend their kits from this basic pattern, adding more drums, more cymbals, and many other instruments including pitched percussion. In some styles of music particular extensions are normal, for example double bass drums in heavy metal music. On the other extreme but more rarely, some performers omit elements from even the basic setup, also dependent on the style of music and individual preferences.

DESCRIPTION OF EXAMPLE EMBODIMENTS

Traditional drum sets are very large and comprise both a large number of components and components, many of which, are large in size. Traditional drum sets are not ideal for students because drum sets are both expensive and they take up a lot of space. Traditional drum sets are also not ideal for a classroom setting, where the goal is to teach students how to play the drums. The go drum is an all-in-one drum kit. The go drum is a compact, versatile, highly portable, and self-contained drum kit.

The figures illustrate an example embodiment of an all-in-one drum kit 100, also referred to as the go drum. Reference now will be made in detail to embodiments of the disclosure, one or more examples of which are illustrated in the figures. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Figure 1:
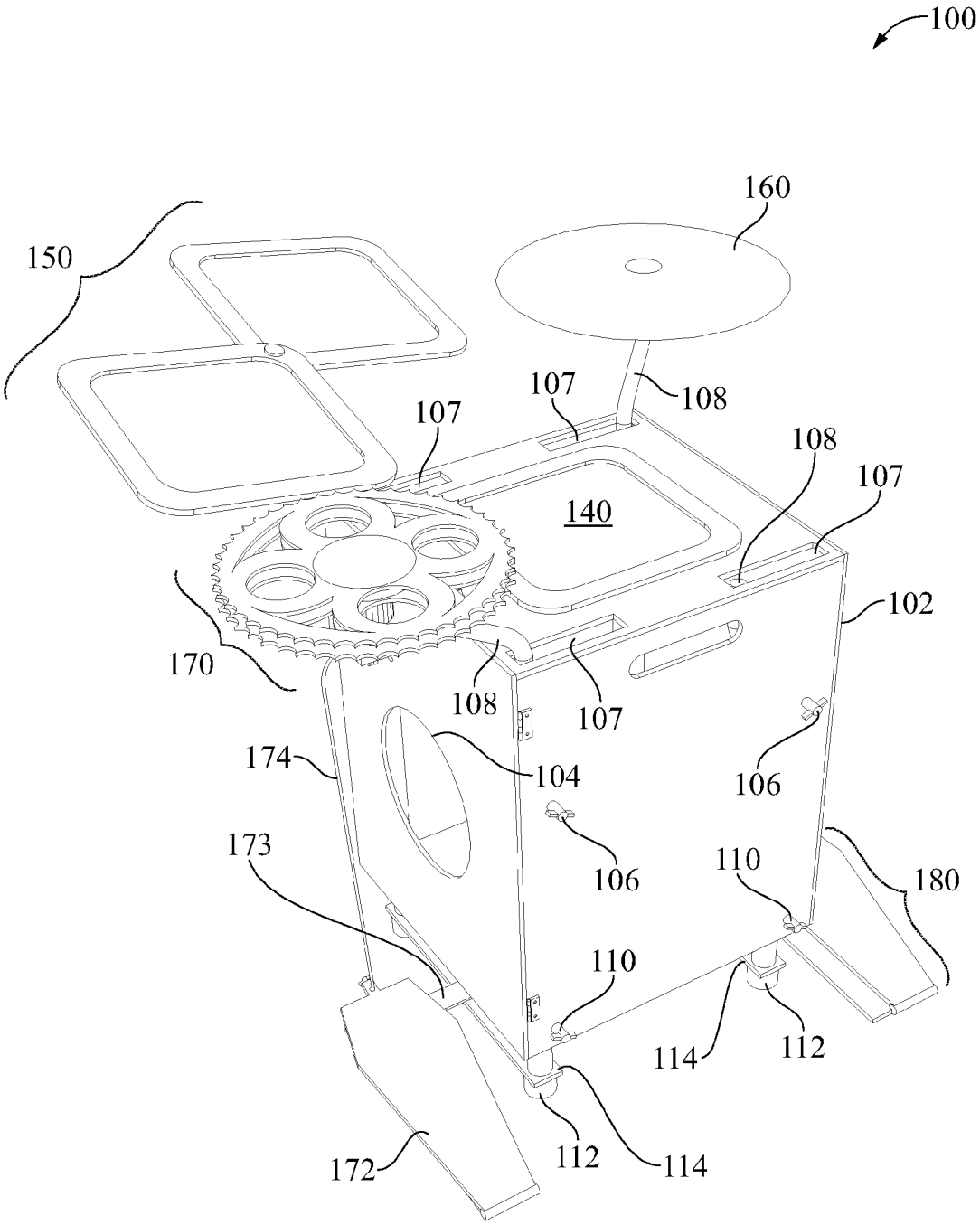
FIG. 1 illustrates an elevated side view of an example embodiment of a go drum.
Figure 2:
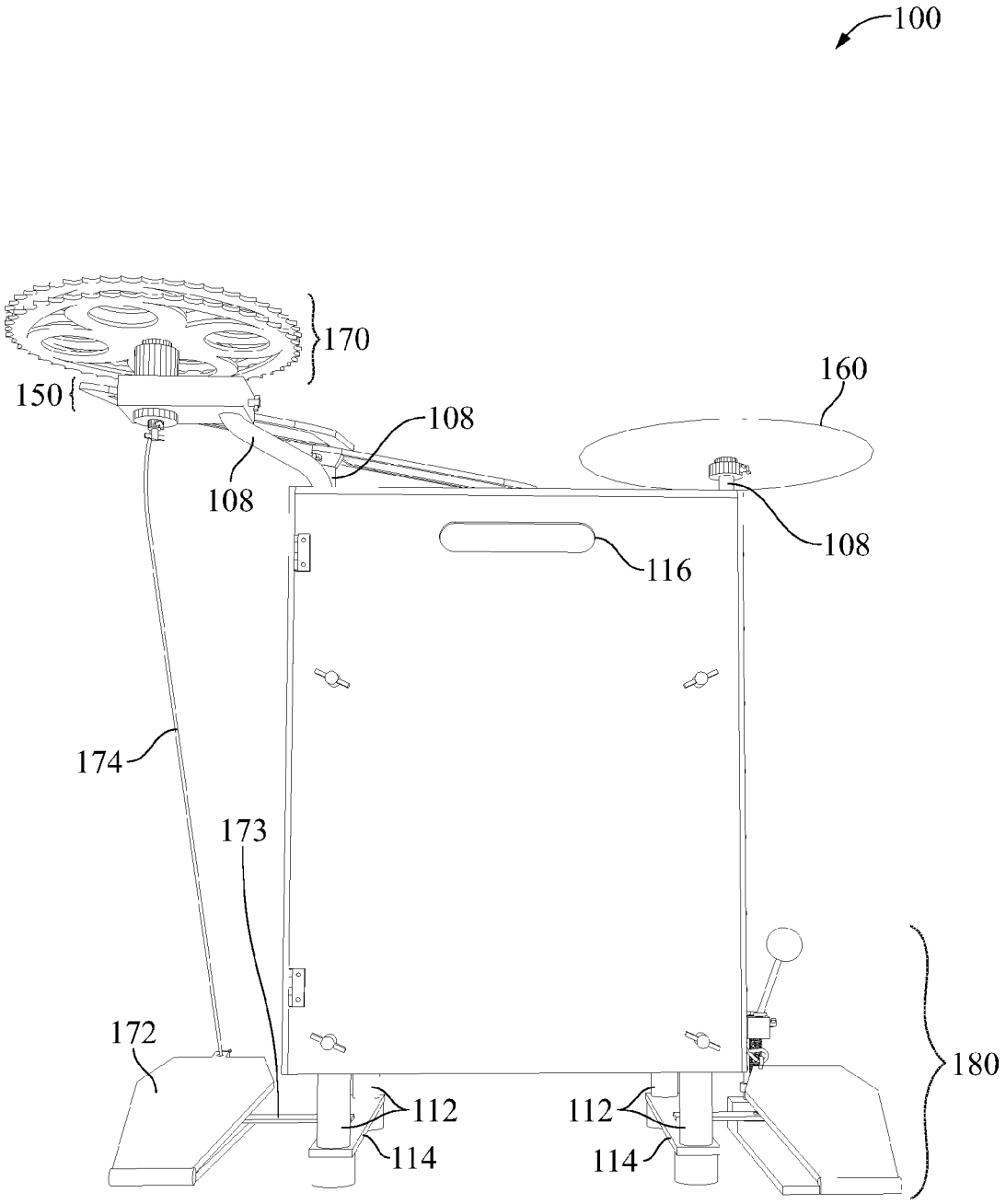
FIG. 2 illustrates a front view of an example embodiment of a go drum.
Figure 3:
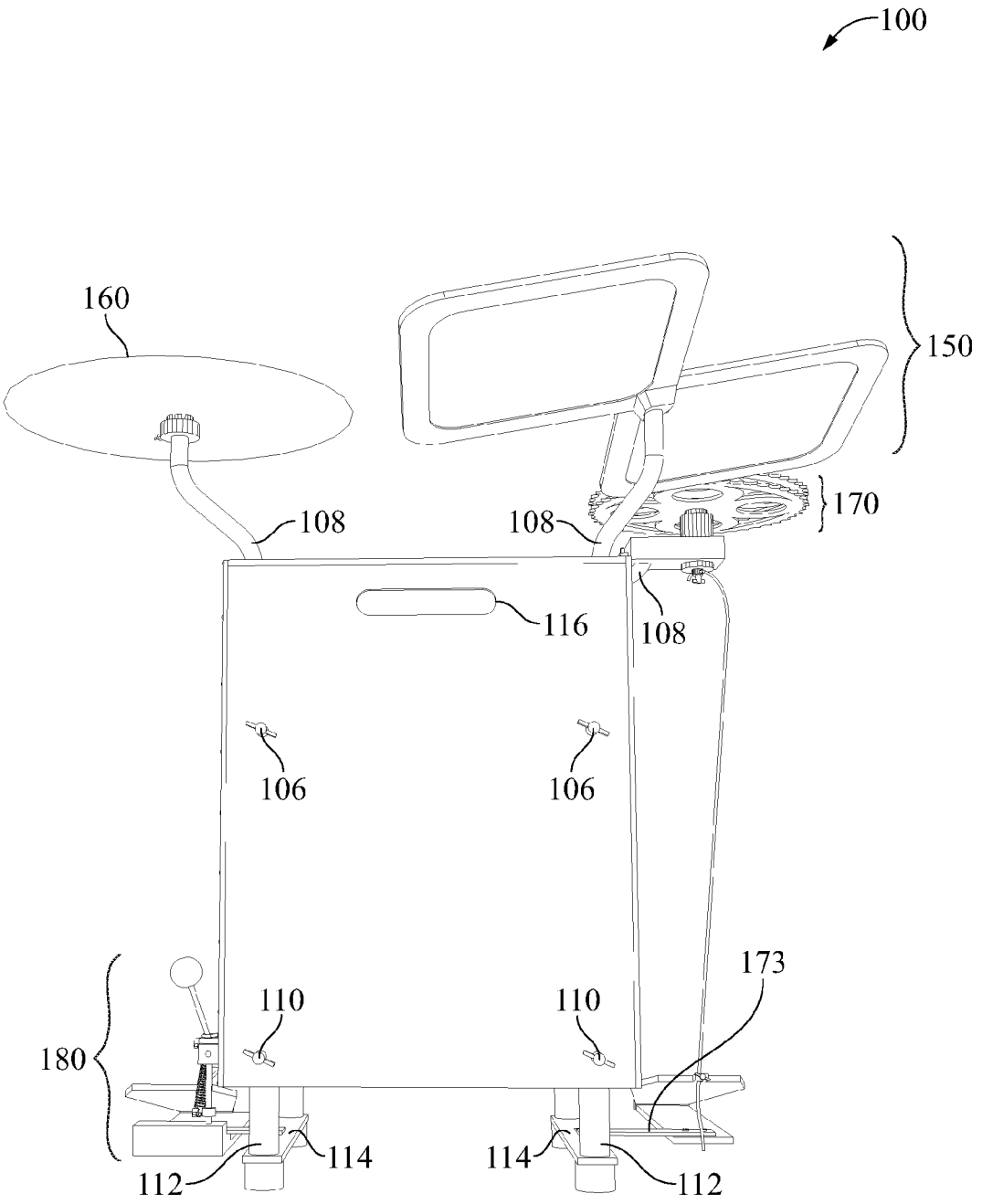
FIG. 3 illustrates a back view of an example embodiment of a go drum.

FIG. 1 illustrates an elevated side view of an example embodiment of a go drum 100 according to the present disclosure. The go drum 100 includes generally a body 102. Body 102 comprises a hollow interior and may be defined by a top, a bottom, and three or more sides connecting the top and bottom. Particular embodiments of body 102 may be a polyhedron of any three dimensional shape, including, but not limited to, a cube, a cylinder that is round or having a top and bottom of any other polygonal shape, a pyramid that is upright or inverted, whole or bisected, having a base comprising a square or any other polygon, and a cone, whole or bisected. In particular embodiments, body 102 may be a box, crate, case, chest, bongo, polygonal with supporting dome, or any other shape in which it would project a sound like a drum when played. In particular embodiments the sides of body 102, the sides of the cylinder may be perpendicular to the top and bottom, or the sides may be non-perpendicular, at an angle more or less than 90 degrees to the top and bottom of body 102. Body 102 may be made of any suitable material, including but not limited to wood, carbon fiber, fiber glass, metal, plastic, and the like.

Figure 4:
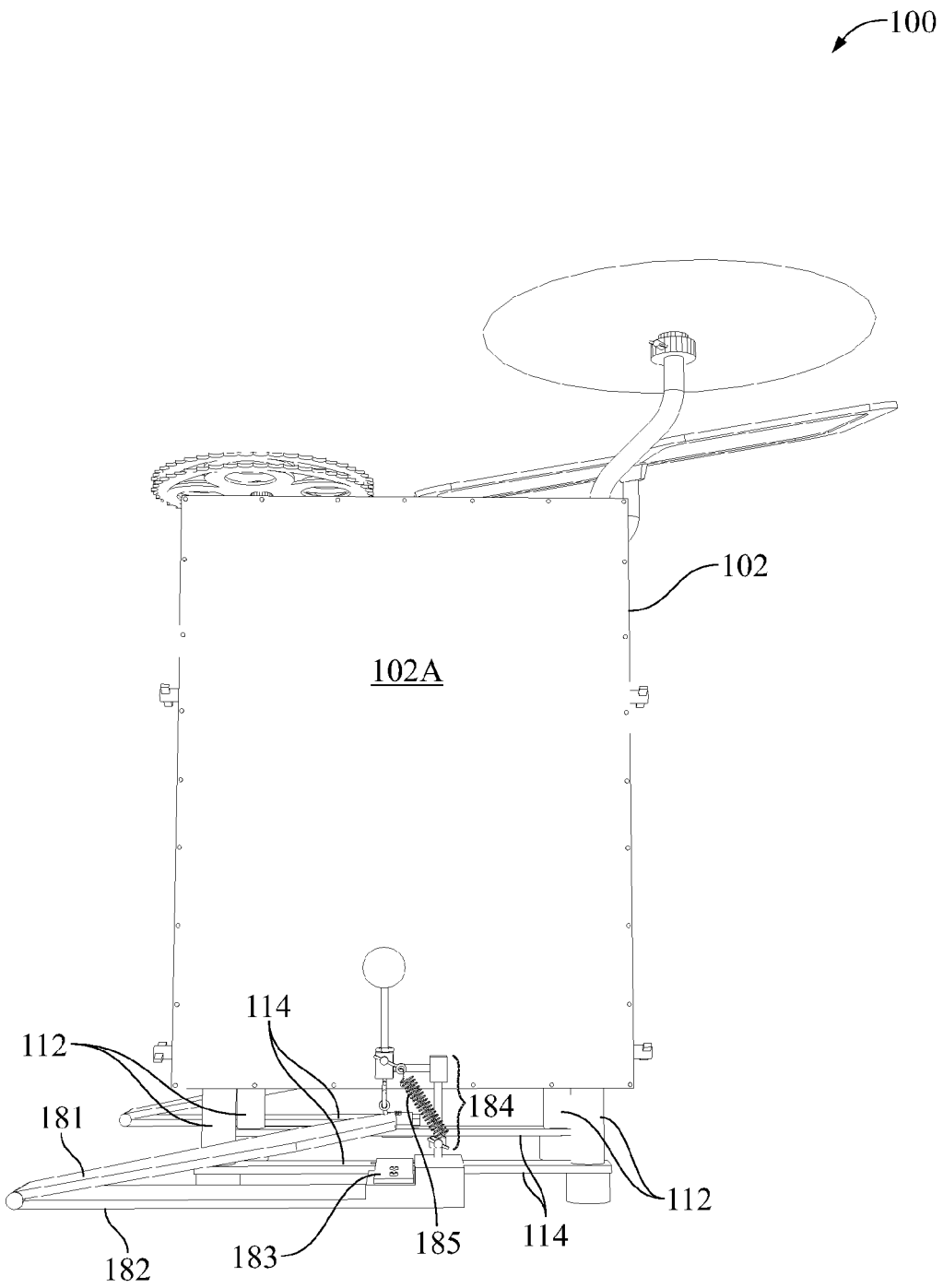
FIG. 4 illustrates a side view of an example embodiment of a go drum.

In particular example embodiments, there are a number of features of body 102 to enable body 102 to behave as a drum. In particular embodiments, body 102 may have a sound hole 104 on a side of body 102 from which sound emanates depending on whether the top or another side of the body 102 is struck. As is shown in FIG. 4, body 102 has a side 102A that may be struck by a drum kick 180. When drum kick 180 strikes side 102A, sound would travel through sound hole 104. In particular embodiments, side 102A may be comprised of the same material as body 102. In particular embodiments, side 102A may be comprised of mylar. In particular embodiments, side 102A may be tunable. In particular embodiments, side 102A may be tunable and comprised of mylar.

Figure 6:
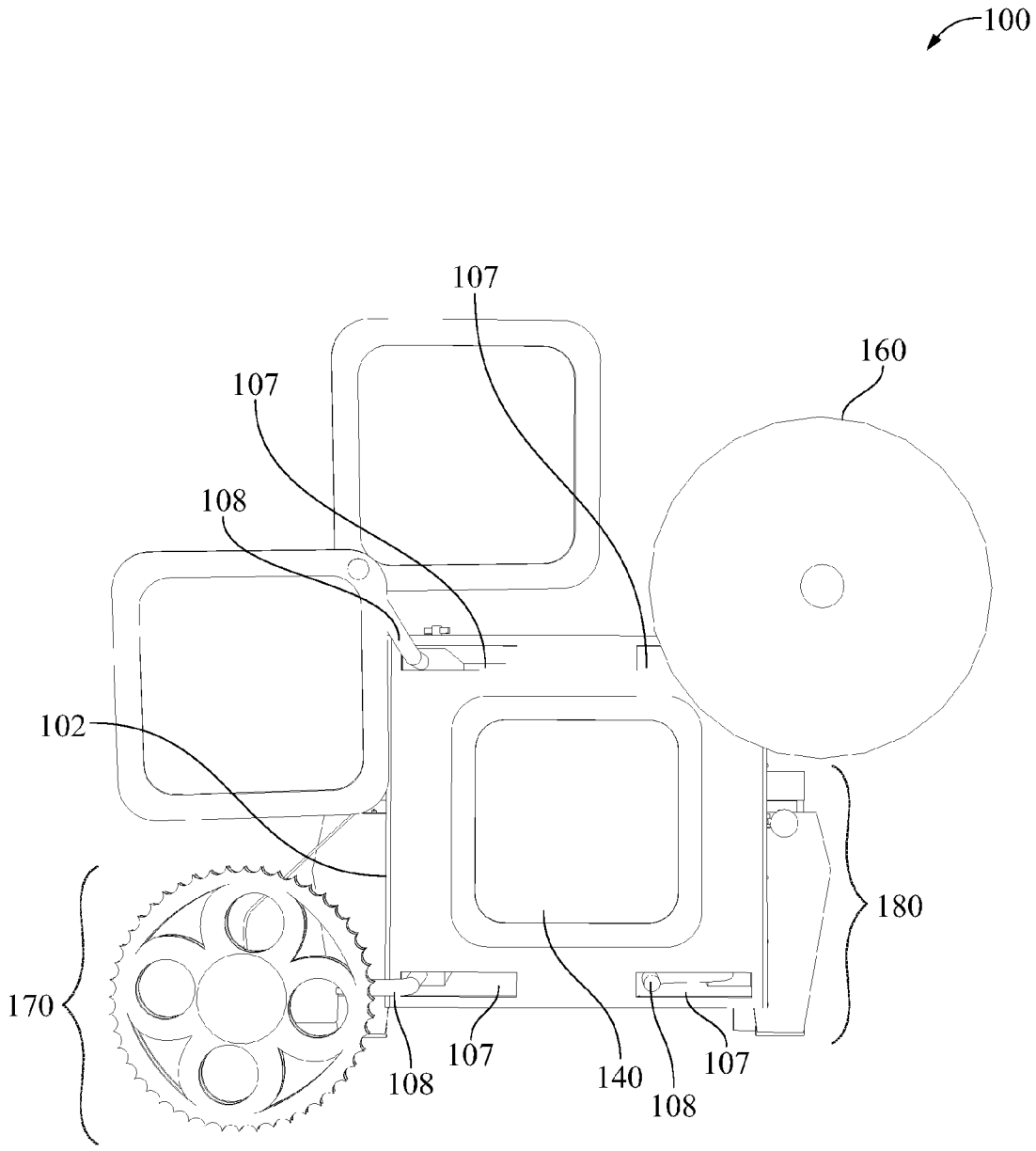
FIG. 6 illustrates a top view of an example embodiment of a go drum.
Figure 7:
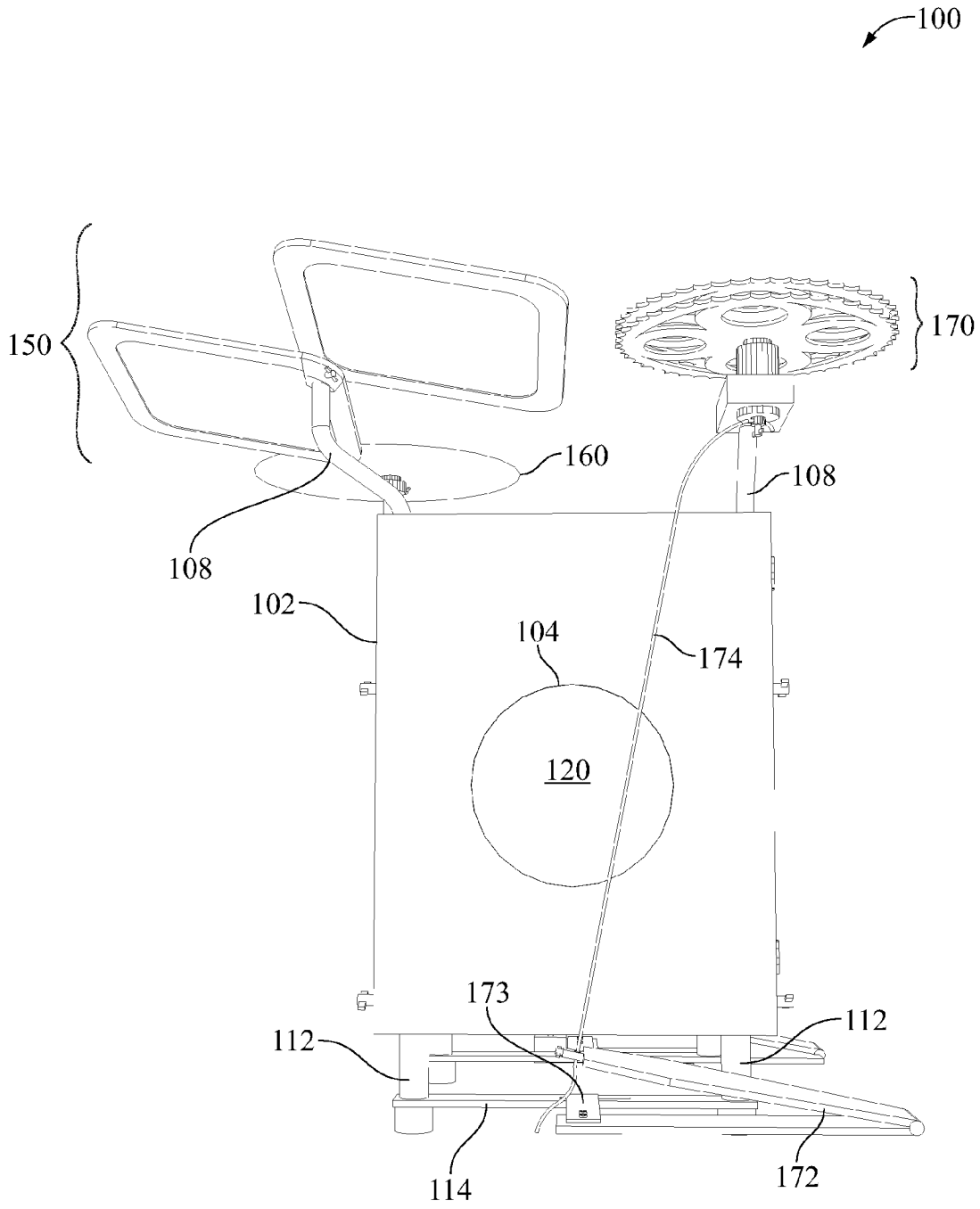
FIG. 7 illustrates an another side view of an example embodiment of a go drum.

As is shown in FIG. 6, the top of body 102 has a top component 140 that may be struck. When top component 140 is struck, sound also travels through sound hole 104. Although in particular embodiments go drum 100 has a sound hole 104 on a particular side of body 102, a sound hole may be located on any side of go drum 100. In particular embodiments, go drum 100 may have no sound hole at all or may have any number of sound holes more than one sound hole. In particular embodiments, a sound hole 104 may comprise any size from very small to an entire side or the bottom of body 102 may be open and functionally behave as a sound hole.

Component shaft 108 extends out of hole 107 in body 102 from the interior cavity 120 to the exterior of body 102. In particular example embodiments, such as that which is shown in FIG. 1, there are four holes 107, from which three component shafts 108 are protruding, and one component shaft 108 remaining recessed below the top of body 102 within the interior cavity of body 102. In particular embodiments, there may be more or less component shafts 108 protruding from body 102 depending on the number of desired components for a particular go drum 100. Component shaft 108 is secured into place by component shaft locking mechanism 106. Component shaft locking mechanism 106 locks and unlocks to allow component shaft 108 to move in and out of body 102 freely or to securely fix component shaft 108 into a particular position. In particular embodiments, component shaft locking mechanism 106 may allow component shaft 108 to rotate on its lengthwise axis or remain at a fixed rotation relative to body 102. Although component shaft locking mechanism 106 is shown as a thumb screw or a wing screw, component shaft locking mechanism 106 may be any suitable locking mechanism. Although component shafts 108 are shown in the in FIG. 1 protruding from the interior of body 102, in particular embodiments, component shafts may instead be mounted on the exterior of body 102, and secured into place by a shaft locking mechanism that is position on the exterior of body 102. In particular embodiments, component shafts that are mounted to the exterior of body 102 may still be raised to hold components or lowered for storage and transport of the go drum 100.

In the example embodiments illustrated in the figures, component shaft 108 is straight for a portion of its length, and curved for another portion of its length. The straight portion of component shaft 108 is primarily so that component shaft 108 may be locked at various heights from completely recessed within body 102 to fully extended the full length of component shaft 108, such that it may still be locked into place with component shaft locking mechanism 106. In particular embodiments, the curved portion of component shaft 108 may be curved in the shape of an "s", or at any other degree or angle in which to allow each of the components to be fastened above body 102. In particular embodiments, component shaft may be entirely straight along its length or any other shape along its length facilitate fastening components to the outside of the body 102.

Component shaft 108 may be smooth, knurled, or spline. In particular embodiments, a portion of component shaft 108 may be smooth and another portion of component shaft 108 may be knurled. In particular embodiments, component shaft 108 may be smooth, knurled, or spline in its entirety. In particular embodiments, component shaft 108 may be solid or hollow. In particular embodiments. component shaft 108 may be made of any suitable material, including but not limited to wood, carbon fiber, fiberglass, metal, or plastic.

As is shown in the figures, various components are attached to various component shafts. In particular embodiments, a component may be attached to a component shaft by a collar lock, thereby fixing the component in place. In particular embodiments, a component may sit on top of a component shaft. Although particular components are shown attached to specific component shafts, it is understood by one in the art that each of the components may be attached to different component shafts in different configurations. In FIG. 1, component 150, 160, and 170 are each attached to particular component shafts 108.

As is shown in FIG. 1, component 150 is fixed atop a component shaft 108. In particular example embodiments, component 150 may be one or more tom-toms. In particular embodiments, component 150 may be a typical tom-tom drum, which is a tom-tom drum comprising a cylindrical drum with no snares comprising a shell, a rim, and a head. In particular example embodiments, component 150 is a tom-tom comprising a frame and a head. In particular embodiments, the tom-tom of component 150 has a head comprising mylar. In particular embodiments each tom-tom of component 150 may be a different size and pitch, such as hi, mid, or low. In particular embodiments, a tom-tom of component 150 may have a frame comprising any shape, including but not limited to a circle, rectangle, or other polygon having a plurality of sides. In particular embodiments, a tom-tom of component 150 may be adjustable so that it may tuned to project sounds of different pitch.

As is shown in FIG. 1, component 160 is fixed atop a component shaft 108. In particular example embodiments, component 160 may be a cymbal. In particular embodiments, component 160 may be one or more cymbals. In particular embodiments, component 160 may be a crash, ride, or crash/ride cymbal.

As is shown in FIG. 1, component 170 is fixed atop a component shaft 108. In particular example embodiments, component 170 may be a pair of hi-hat cymbals. Hi-hat pedal 172 is shown to the left of body 102 so that a left foot of a drummer may operate hi hat pedal 172, pulling connector 174, thus, causing component 170 to project sound. In particular embodiments, pulling connector 174 may be a string, rope, or wire that is inelastic or elastic.

Figure 5:
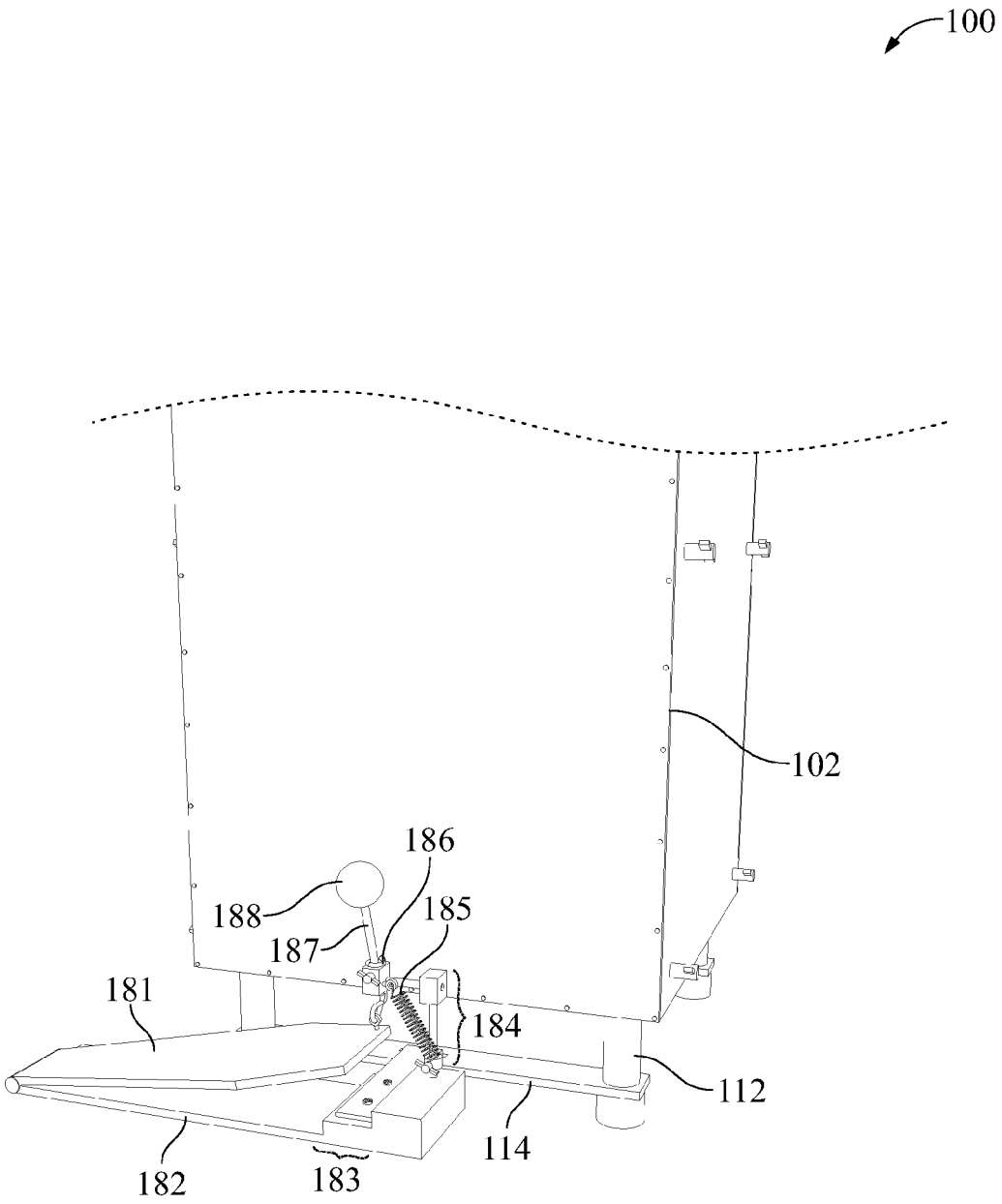
FIG. 5 illustrates a zoomed view of an example kick pedal of an example embodiment of a go drum.
Figure 9A:
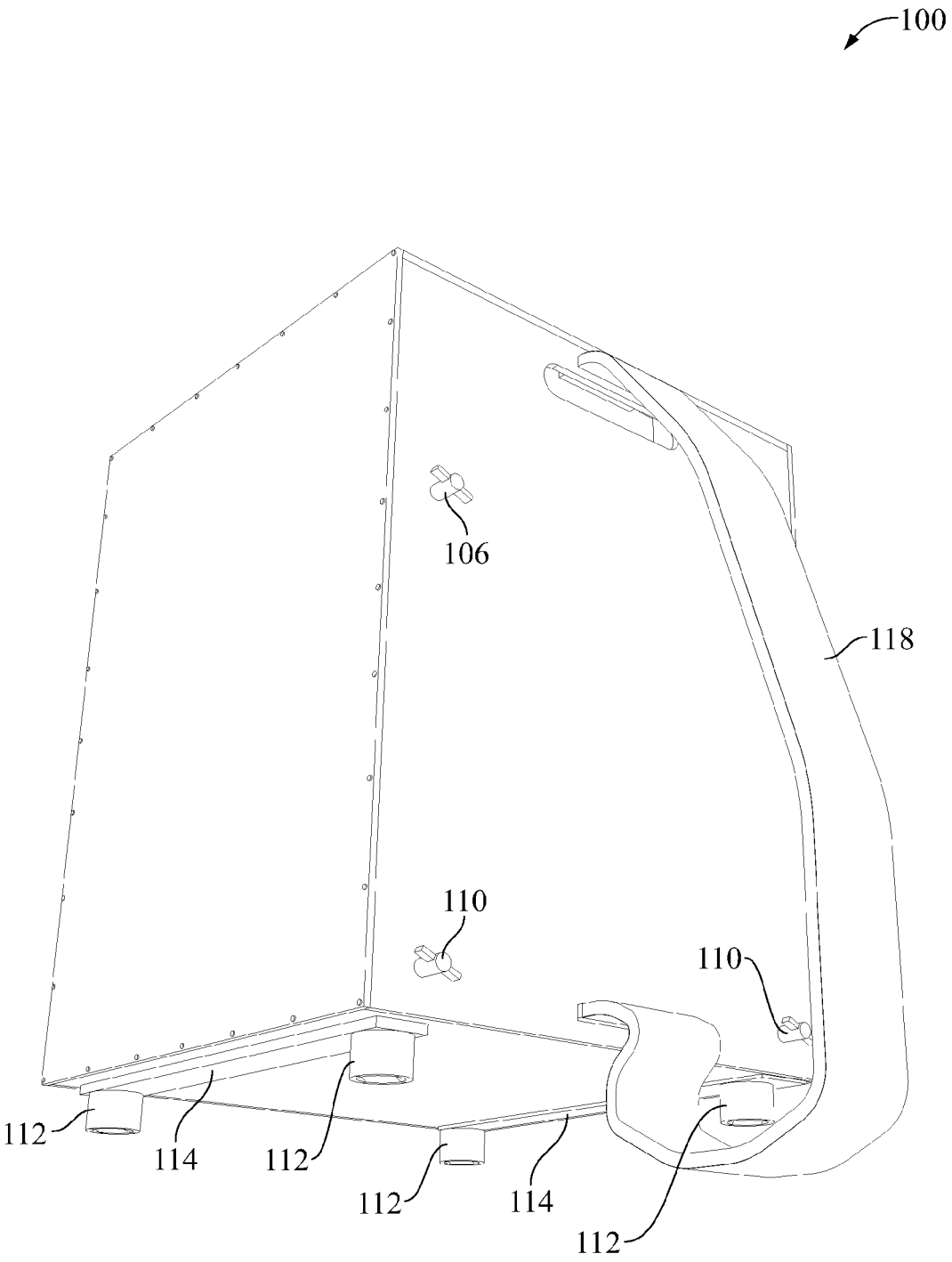
FIG. 9A illustrates a bottom rear perspective view of an example embodiment of a go drum.

As is shown in FIG. 1, drum kick 180 is positioned to the right of body 102 so that a right foot of a drummer may operate drum kick 180. FIG. 5 illustrates a zoomed view of an example kick pedal 180 of an example embodiment of a go drum 100. In particular example embodiments, drum kick 180 comprises a drum pedal 181, a drum pedal base 182, a kick pedal bar 183, a beater mount 184, a spring 185, a connector 186, a beater extension 187, and a beater 188. In particular embodiments kick pedal bar 183 may attach to bar 114 in order to secure drum kick 180 in place. When drum pedal 181 is pressed downward, it pulls connector 186 downward. Due to the configuration of beater mount 184, when connector 186 is pulled downward by drum pedal 181, it also simultaneously pulls beater extension 187 toward side 102A of body 102, which causes beater 188 to strike side 102A. When drum pedal 181 is released, each moving component of drum kick 180 moves in the opposite direction because spring 185 pulls beater extension 187 the opposite direction of connector 186, returning drum pedal 181, connector 186, beater extension 187, and beater 188 into their original positions. Leg shaft 112 extends out of a hole in the bottom of body 102 from the interior cavity of body 102 to the exterior of body 102. In particular example embodiments, such as that which is shown in FIG. 9A, there are four leg shafts 112. In particular embodiments, there may be more or less leg shafts 112 protruding from body 102 depending on the number of leg shafts necessary to support the body 102 in a desirable position for playing go drum 100. Leg shaft 112 is secured into place by leg shaft locking mechanism 110. Leg shaft locking mechanism 110 locks and unlocks to allow leg shaft 112 to move in and out of body 102 freely or to securely fix leg shaft 112 into a particular position. In particular embodiments, leg shaft locking mechanism 110 may allow leg shaft 110 to rotate on its lengthwise axis or remain at a fixed rotation relative to body 102. Although leg shaft locking mechanism 110 is shown as a thumb screw or a wing screw, leg shaft locking mechanism 110 may be any suitable locking mechanism. In particular embodiments, leg shaft 112 may be entirely straight along its length or any other shape along its length to facilitate maintaining the body 102 in a position desirable to be able to play go drum 100.

Leg shaft 112 may be smooth, knurled, or spline. In particular embodiments, a portion of leg shaft 112 may be smooth and another portion of leg shaft 112 may be knurled. In particular embodiments, leg shaft 112 may be smooth, knurled, or spline in its entirety. In particular embodiments, leg shaft 112 may be solid or hollow. In particular embodiments. leg shaft 112 may be made of any suitable material, including but not limited to wood, carbon fiber, fiberglass, metal, or plastic.

In particular example embodiments, bar 114 is secured to two leg shafts 112 and extending the entire distance between the two leg shafts 112. In particular embodiments, hi-hat pedal bar 173 or kick pedal bar 183 may be securely fastened to bar 114 by a clamp and the like. In particular embodiments, bar 114 may have one or more slits that receive a hi-hat pedal bar 173 or a kick pedal bar 183. The one or more slits allow the hi-hat pedal bar 173 or the kick pedal bar 183 to be anchored to the bar 114.

FIG. 6 illustrates a top view of an example embodiment of a go drum. In particular embodiments, top component 140 may be a snare drum. In particular embodiments, top component 140 may be independent of body 102 and merely be placed on the top of body 102. In particular embodiments, top component 140 may be integrated into the top of body 102, where the top of body 102 comprises a frame surrounding the strikable surface of component 140. In particular embodiments, the top of body 102 may itself be top component 140. In particular embodiments, component 140 may be composed of mylar. In particular embodiments, component 140 may be tunable. In particular embodiments, component 140 may be tunable and comprised of mylar.

Figure 8:
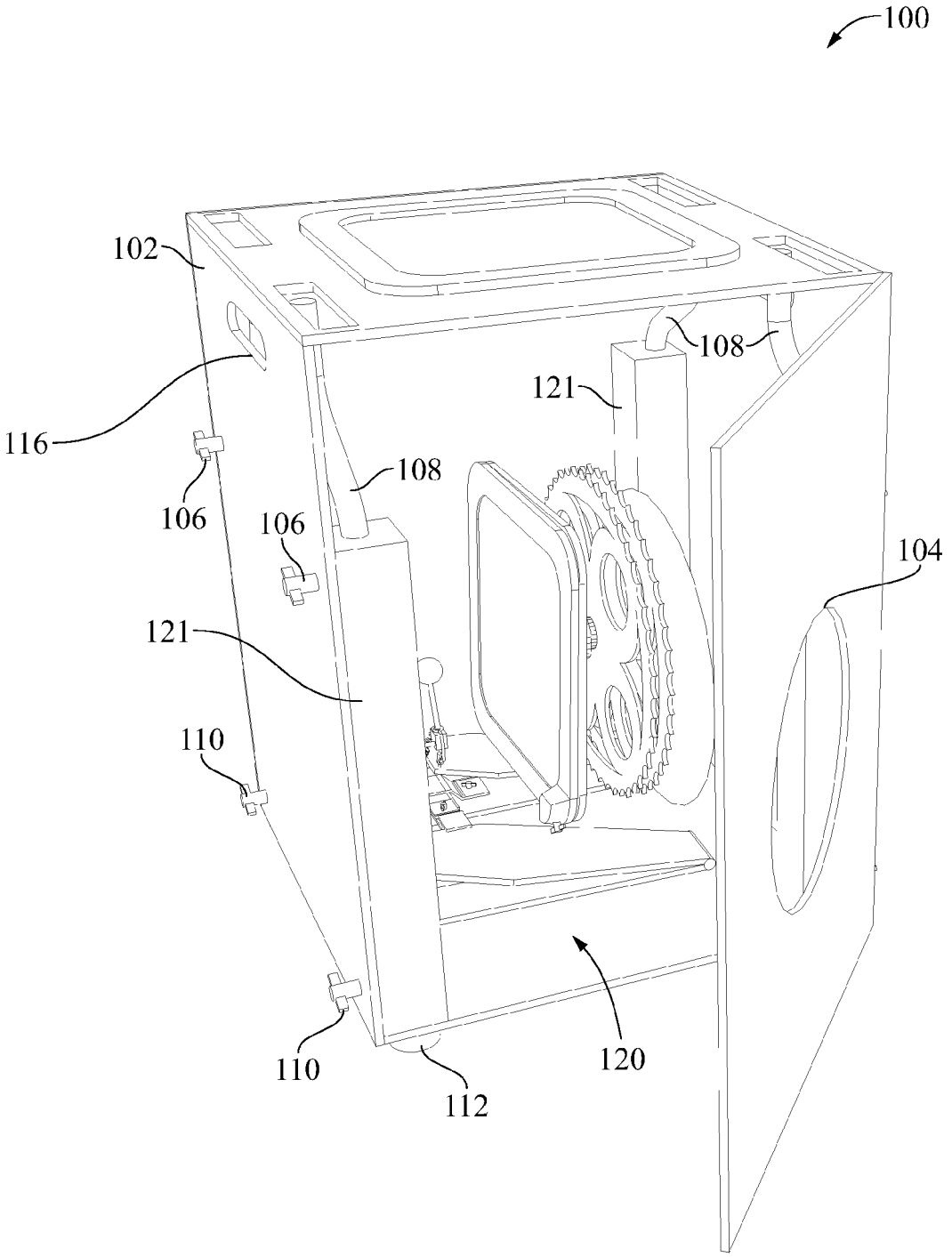
FIG. 8 illustrates an internal view of an example embodiment of a go drum.

In particular embodiments, body 102 may be different sizes, thus having varying degrees of compactness and portability. In particular embodiments, body 102, with its hollow interior, is of a particular size to accommodate each of the components that make up the go drum 100. FIG. 8 illustrates an internal view of an example embodiment of a go drum. FIG. 8 illustrates a view of an interior cavity 120 of body 102. In interior cavity 120, there is a shaft support cavity 121 for supporting each of component shaft 108 and leg shaft 112. Shaft support cavity 121 may comprise a single cavity or more than one cavity depending on how many component shafts and leg shafts will extend from the interior 120 of body 102. In particular embodiments, shaft support cavity 121 may be located on the outside of body 102, as opposed to in the interior cavity 120. In particular embodiments, shaft support cavity 121 may extend the full distance between top and bottom of body 102 or shaft support cavity 121 may extend only a portion of the distance between top and bottom of body 102. In particular embodiments, there may be a plurality of shaft support cavities 121. Shaft support cavities 121 may have an opening that faces the top or bottom of body 102.

Figure 9B:
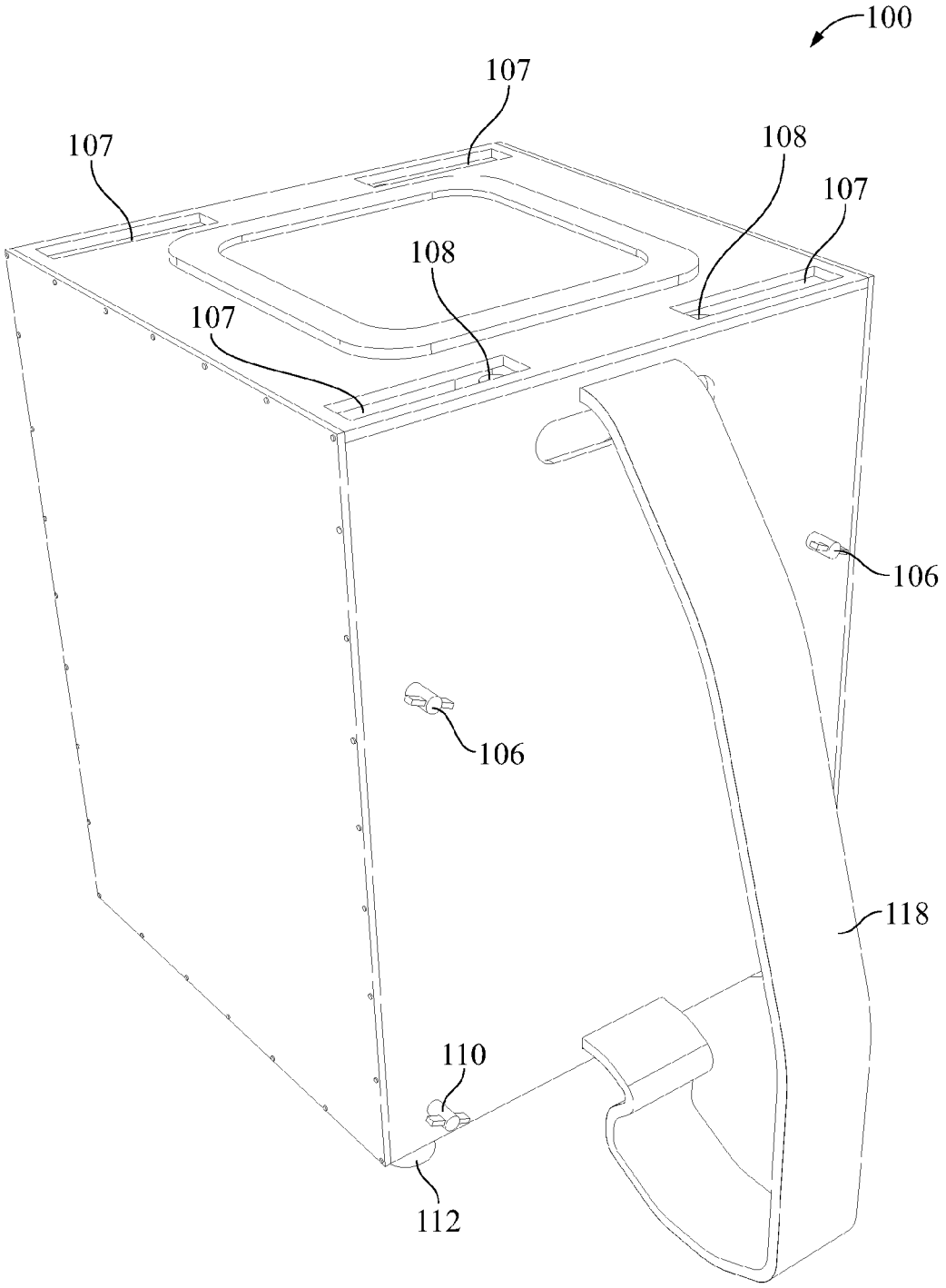
FIG. 9B illustrates a top rear perspective view of an example embodiment of a go drum.

In particular embodiments, the go drum is an extremely portable, all-inclusive drum set. Specifically, portability is a particular advantage of the go drum. In particular embodiments, when it is fully packed-up, there are very few protrusions from the body 102, which makes the go drum highly portable, easy to carry, and easy to transport. FIG. 9A illustrates a bottom rear perspective view of an example embodiment of a go drum. FIG. 9B illustrates a top rear perspective view of an example embodiment of a go drum. In each of FIGS. 9A and 9B, go drum 100 is shown in a packed configuration. This means that component shafts 108 are stored recessed into the cavity 107 of body 102, leg shafts are stored recessed into body 102, with bar 114 resting on the bottom of body 102, and all of the components are packed within the interior cavity 120 of body 102. In the example embodiments of FIGS. 9A and 9B, go drum 100 is in its most portable configuration. In particular embodiments a strap 118 may be attached to body 102 to enable a person to easily carry go drum 100. Strap 118 may be a single strap or multiple straps. Strap 118 may be configured to enable a person to carry go drum 100 as a messenger bag, purse, or backpack.

In particular example embodiments, go drum 100 may be carried by hand hold 116. In the figures, hand hold 116 is shown on a front and a back side of body 102 of go drum 100, but hand hold 116 could be placed on any side of body 102. As shown in the figures, particular example embodiments of hand hold 116 comprise an elongated hole in body 102. In particular embodiments, there may be one or more hand holds 116 on body 102. In particular embodiments, hand hold 116 may be a strap, grip, protrusion, or any other mechanism that enables a person to carry go drum 100.

Particular embodiments of go drum 100 may be acoustic, electric, or MIDI. With the addition of particular types of pickups strategically placed on body 102 and each of the components, particular embodiments of go drum 100 may produce an amplified or digitized sound.

Although it is not shown on go drum 100, body 102 may have another hole or receptacle attached to body 102 for the storage and retrieval of drum sticks.

Figure 10:
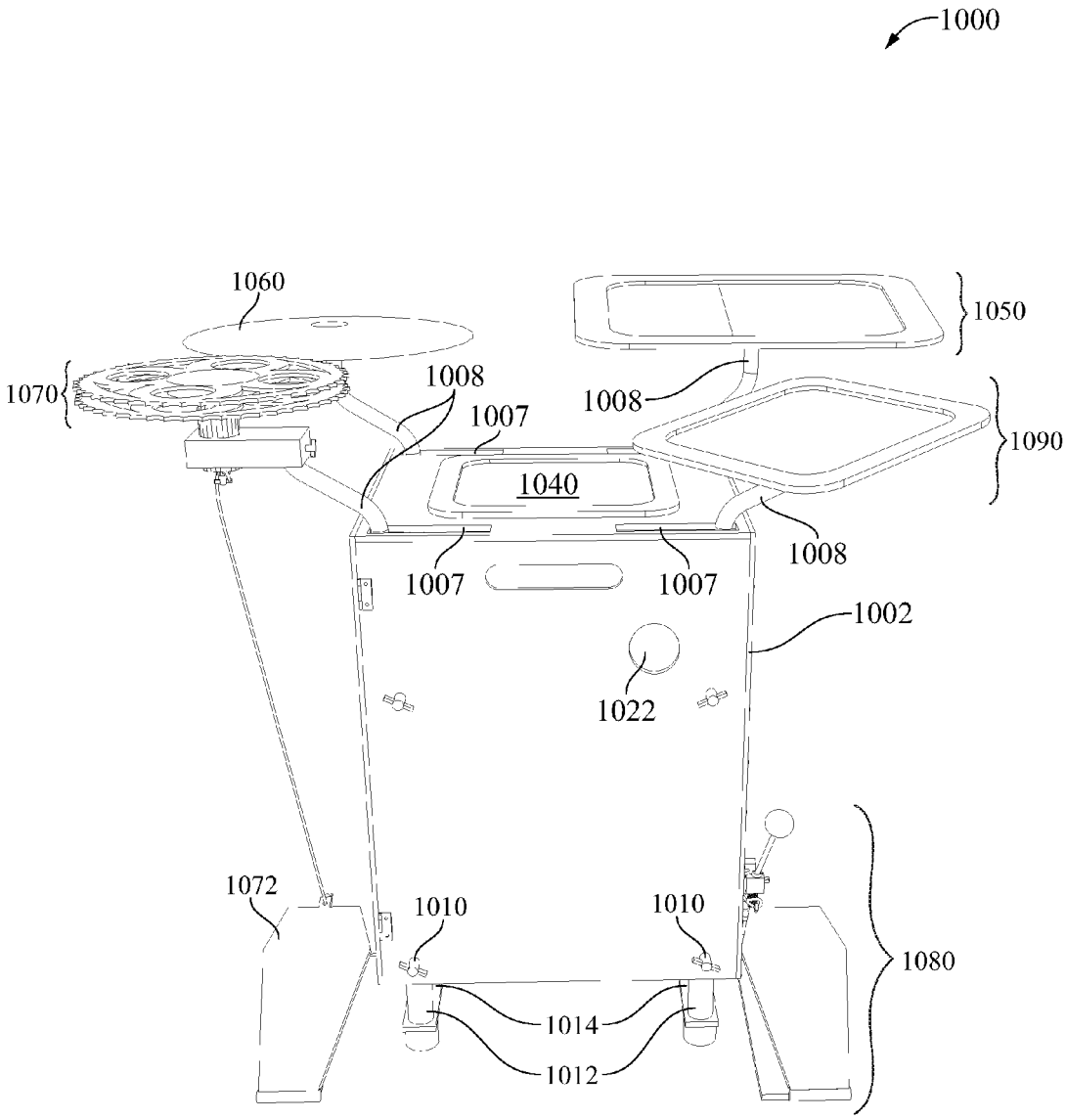
FIG. 10 illustrates an elevated side view of another example embodiment of a go drum.

FIG. 10 illustrates an elevated side view of another example embodiment of a go drum 1000. In the example embodiment shown in FIG. 10, many elements are present as are present in other example embodiments. Go drum 1000 has a body 1002, component shaft 1008, hole 1007 in body 1002 from which component shaft 1008 extends to hold components or recesses to be stored within body 1002. Go drum 1000 has leg shaft 1012 and leg shaft locking mechanisms 1010. Bar 1014 connects leg shafts 1012 and provides support for attaching and securing various pedals to go drum 1000. Body 1002 has a component 1040 on the top of the body 1002. Body 1002 has a drum stick hole 1022 in which drum sticks may be inserted into the interior of the body 1002 in such a way that they protrude slightly to the outside of body 1002. In particular embodiments, drum sticks may be stored in drum stick hole 1022 when they are not being used on drum 1000. In the example embodiment shown in FIG. 10, there is a different component configuration. In the embodiment shown in FIG. 10, there are components attached to each component shaft 1008.

Go drum 1000 comprises a drum kick 1080 like the drum kick 180 described above. Go drum 1000 comprises a component 1050, 1060, 1070, and 1090 attached to each component shaft 1008. In particular embodiments, component 1070 may be a hi-hat like the component 170 described above, including hi-hat pedal 1072 that is used to operate component 1070 with a foot. In the embodiment shown in FIG. 10, component 1070 resides in the front-left component shaft 1008. In particular embodiments, component 1060 may be a cymbal like the component 160 described above. In the embodiment shown in FIG. 10, component 1060 resides in the rear-left component shaft 1008. In particular embodiments, component 1050 may be a two-tone tom. In particular embodiments, component 1050 may be fretted. In particular embodiments, component 1050 may be tunable. In particular embodiments, component 1050 may be fretted, two-tone, and tunable. In the embodiments shown in FIG. 10, component 1050 resides in the rear-right component shaft 1008. In particular embodiments component 1090 may be a tom like the component 150 described above. In particular embodiments, component 1090 may be a low-pitched tom. In particular embodiments, component 1090 may be a tunable tom. In particular embodiments, component 1090 may be a low-pitched tunable tom.

Figure 11A:
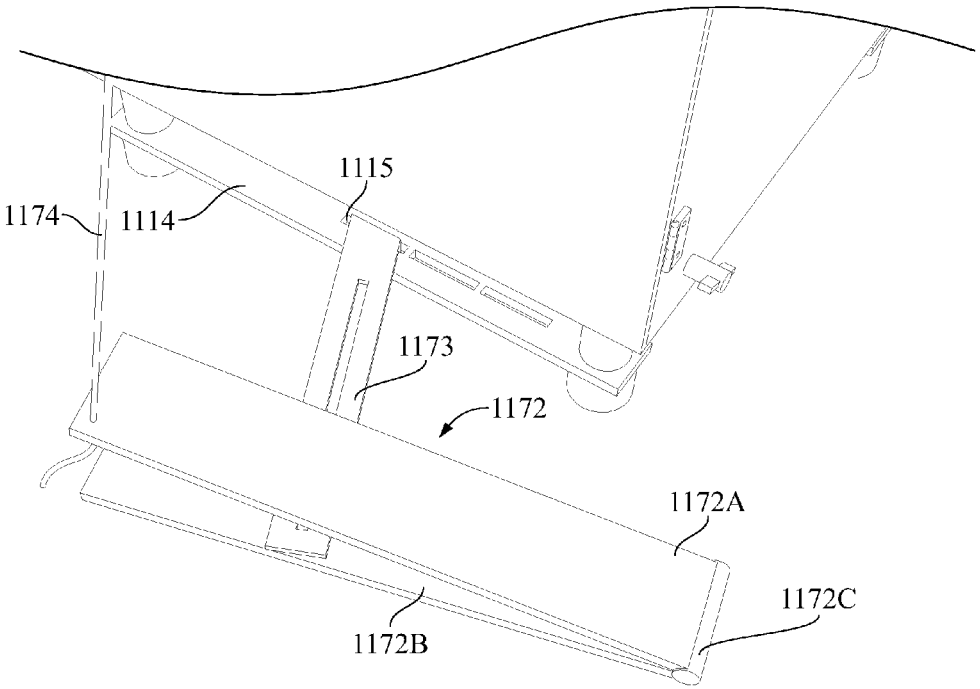
FIG. 11A illustrates an elevated perspective view of an example hi-hat pedal.
Figure 11B:
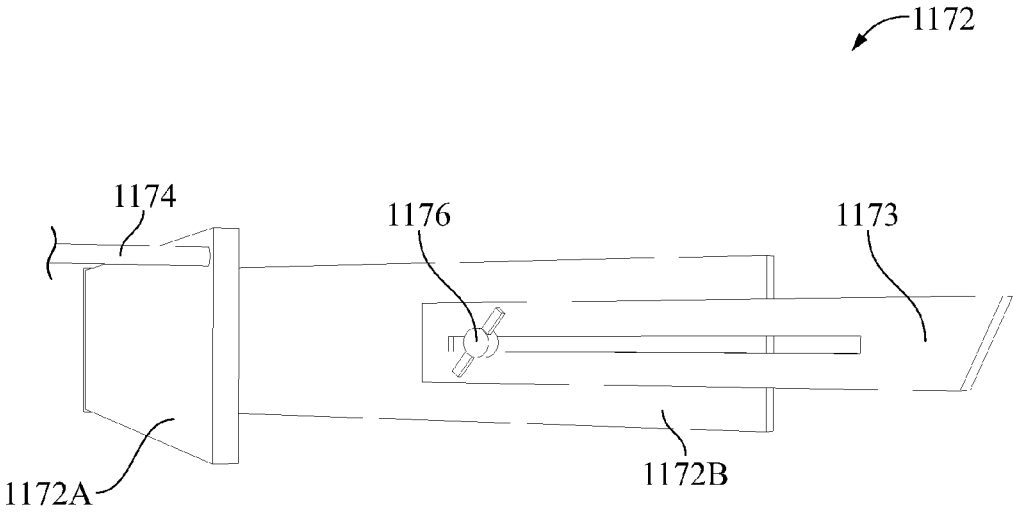
FIG. 11B illustrates a top view of an example hi-hat pedal.
Figure 11C:
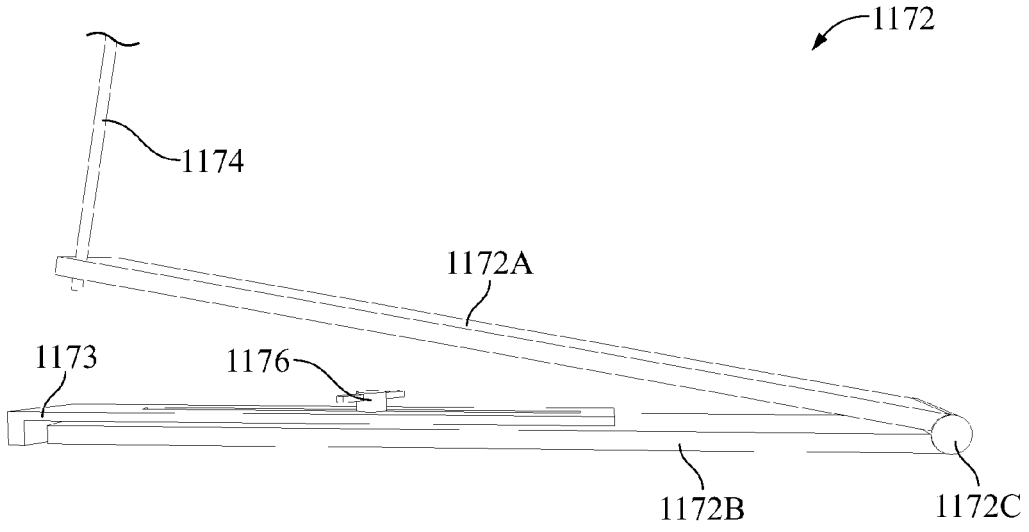
FIG. 11C illustrates a side view of an example hi-hat pedal.

FIGS. 11A-11C illustrate a portion of go drum 1000, in particular hi-hat pedal 1172. In particular embodiments, hi-hat pedal 1172 may be a hi-hat pedal like components 172 and 1072 described above. Hi-hat pedal 1172 is comprised of a number of parts, including footboard 1172A, base plate 1172B, and connector 1172C. In particular embodiments, connector 1172C may be a heel hinge, such as a heel hinge that connects footboard 1172A and 1172B. In particular embodiments, pulling connector 1174 is attached to foot board 1172A opposite connector 1172C.

In particular embodiments, hi-hat pedal 1172 attaches to bar 1014 via hook 1173. In particular embodiments, hook 1173 may be a metal bar with an angled downward protrusion for attaching to slot 1115 of bar 1114, as shown in FIGS. 11B and 11C. Hook 1173 may be an anchoring hook that is slotted so that it may be attached at various distances from the drum body. The slot in hook 1173 may run a portion of the length of hook 1173 or it may run substantially the entire length of hook 1173. In particular embodiments, the end of hook 1173 that attaches to slit 1115 of bar 1114 may be angled so that hi-hat pedal 1172 may be angled to the body of the drum. In particular embodiments, the end of hook 1173 may perpendicular to the side edges of hook 1173 so that hi-hat pedal 1172 may be perpendicular to the body of the drum. In particular embodiments, hook 1173 may be anchored to hi-hat pedal 1172 by a wing screw 1176 that securely fastens hook 1173 to base plate 1172B through the slot in hook 1173.

Figure 12A:
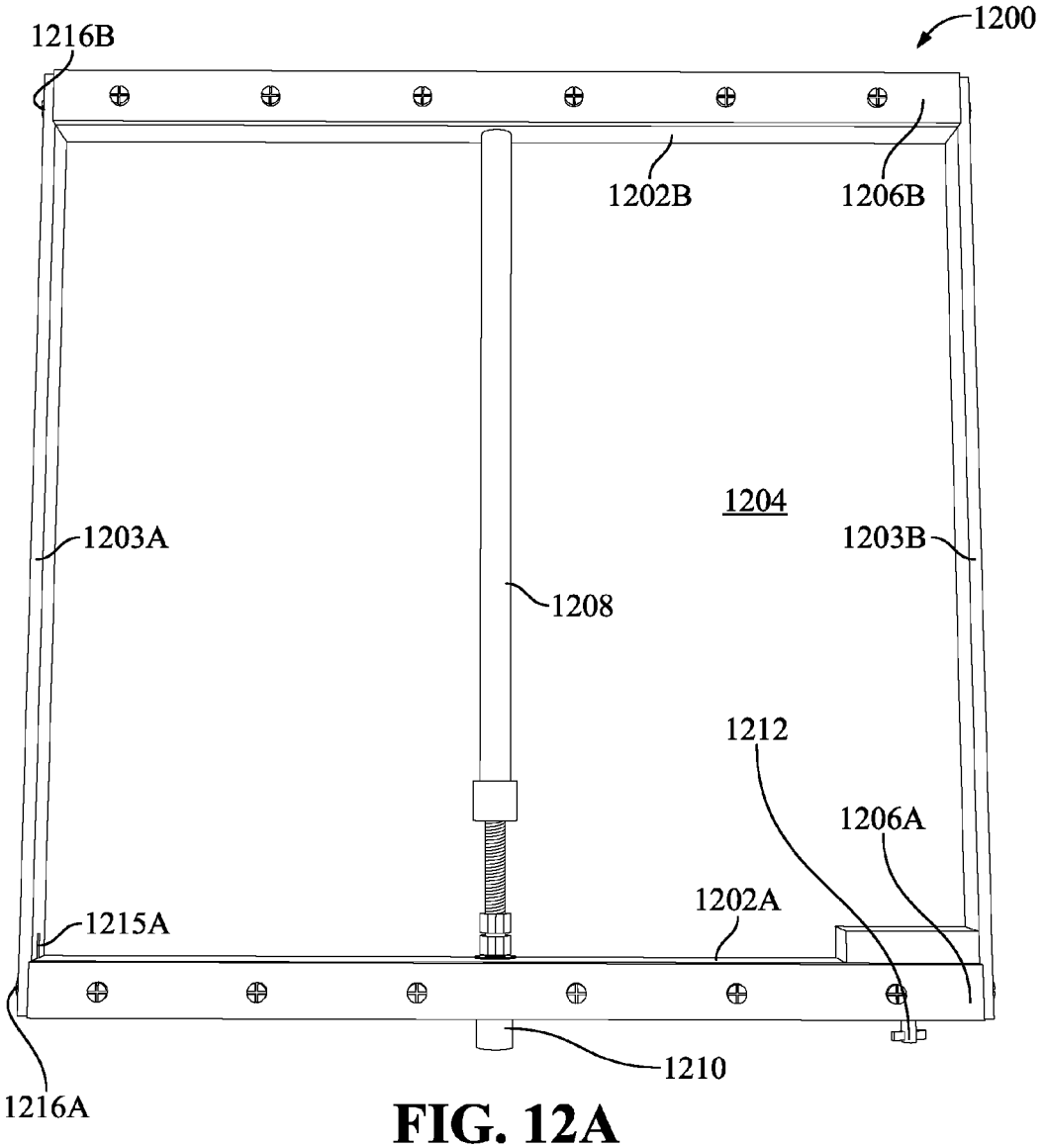
FIG. 12A illustrates a top view of an example tom.
Figure 12B:
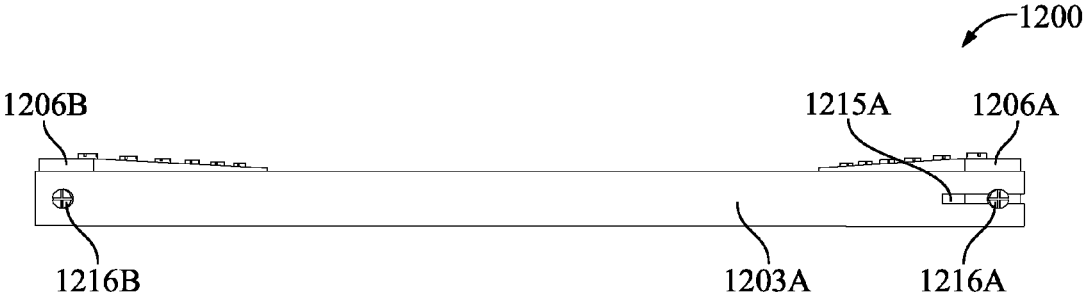
FIG. 12B illustrates a side view of an example tom.
Figure 12C:
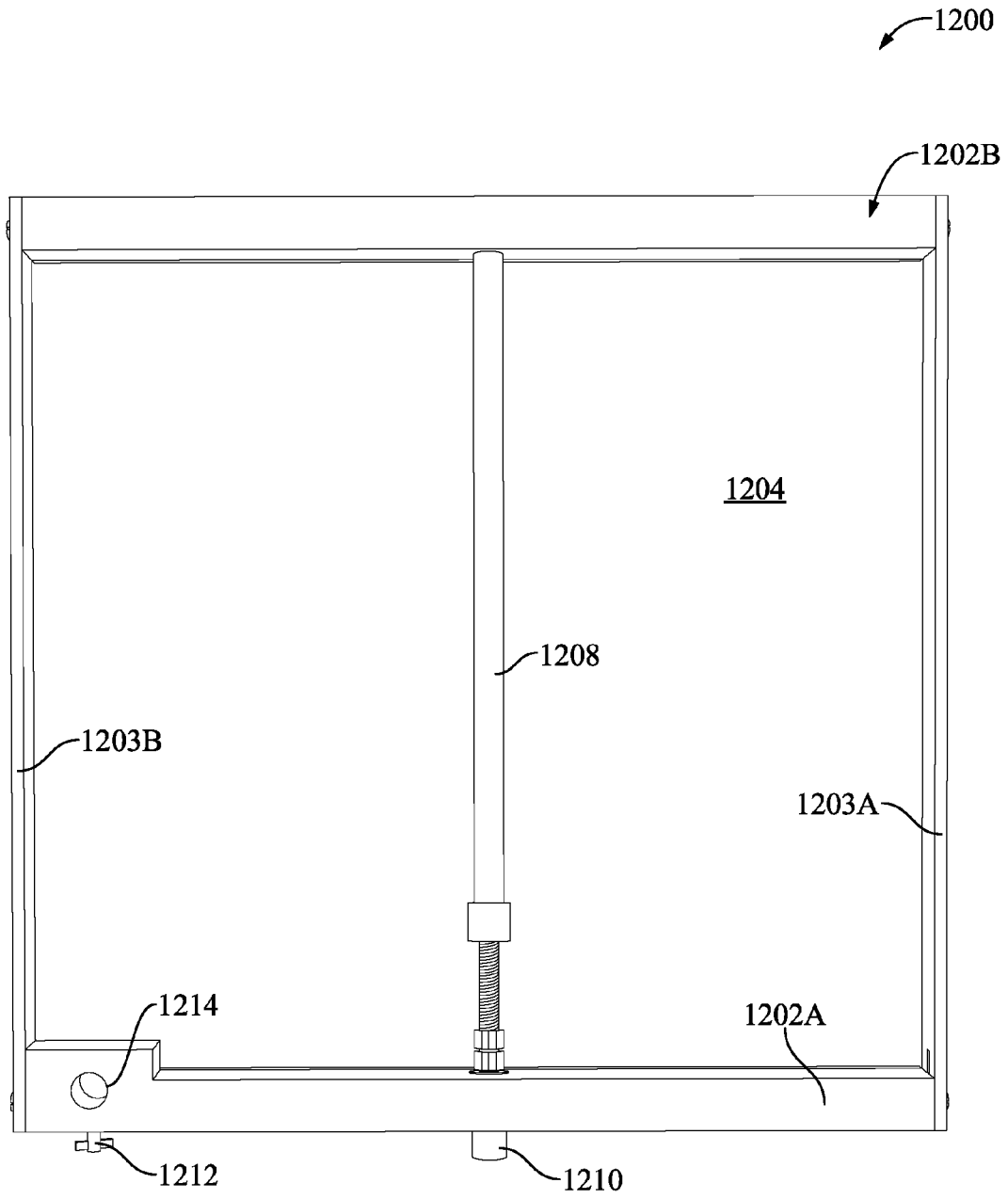
FIG. 12C illustrates a bottom view of an example tom.

FIGS. 12A-12C illustrate an example tunable tom 1200 that may be used with the go drum. FIG. 12A illustrates a top view of an example tunable tom 1200. FIG. 12B illustrates a side view of an example tunable tom 1200. FIG. 12C illustrates a bottom view of an example tunable tom 1200. In particular embodiments, tunable tom 1200 comprises slats 1203A, 1203B, 1202A, 1202B that form a square frame. In particular embodiments, a drum head 1204 is fixed to slats 1202A and 1202B by bars 1206A and 1206B, that are mounted on slats 1202A and 1202B respectively with one or more screws. In particular embodiments, drum head 1204 covers the entire surface created by the square frame of slats 1203A, 1203B, 1202A, and 1202B. In particular embodiments, slats 1202A and 1202B are connected by a tuning rod 1208 that lengthens or shortens to lower or raise the pitch of tunable tom 1200. In particular embodiments, tuning knob 1210 controls the length of tuning rod 1208. In particular embodiments, slats 1203A and 1203B have a slit 1215A, 1215B (not shown) respectively, on the end of the slat proximal to slat 1202A. In particular embodiments, tunable tom 1200 may have a mounting hole 1214 for mounting tunable tom 1200 to a component shaft and a mounting screw 1212 that secures tunable tom 1200 to the component shaft. In particular embodiments, screw 1216B secures side slat 1203A to side slat 1202B. As shown in FIG. 12B, in particular embodiments, screw 1216A is affixed to side slat 1202A through slit 1215A. In particular embodiments, slit 1215A allows slat 1202A to move freely as the length of tuning rod 1208 changes.

Figure 13A:
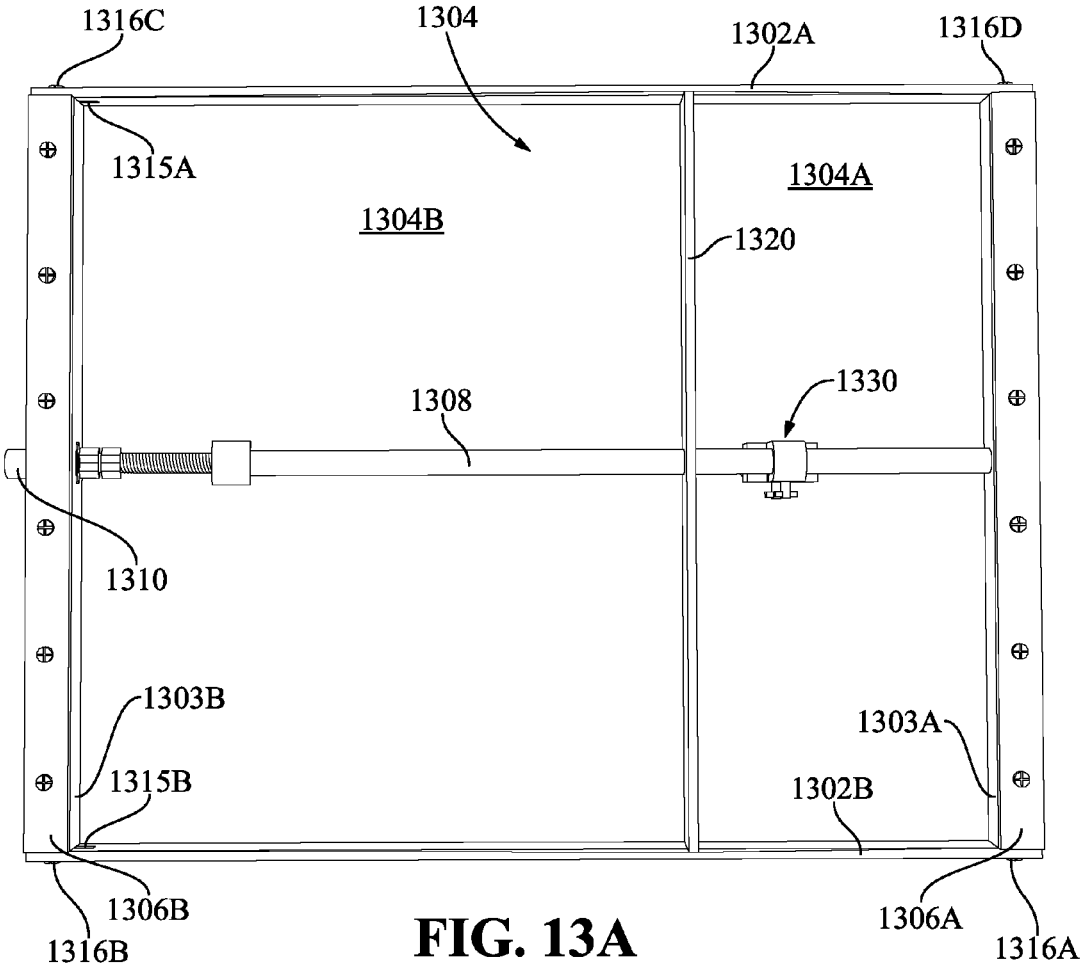
FIG. 13A illustrates a top view of another example tom.
Figure 13B:
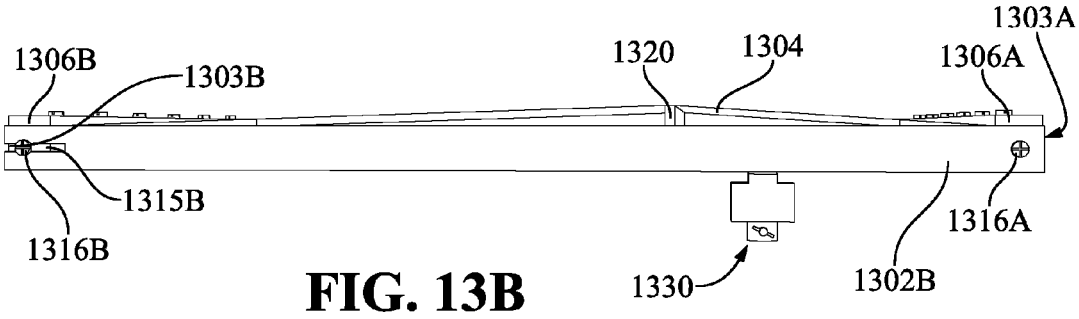
FIG. 13B illustrates a side view of another example tom.
Figure 13C:
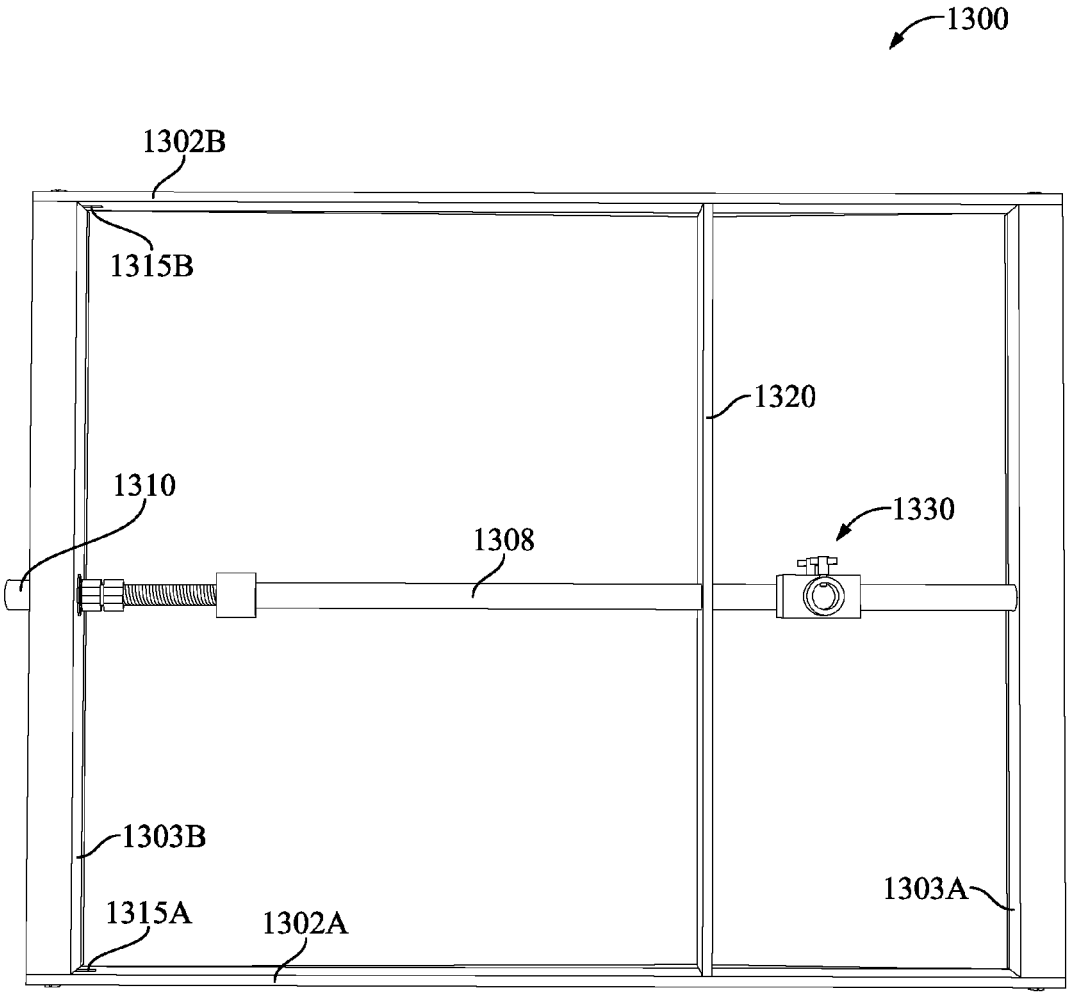
FIG. 13C illustrates a bottom view of another example tom.

FIGS. 13A-C illustrate different views of another example tunable tom 1300 that may be used with the go drum. In particular embodiments, the another example tunable tom 1300 shown in FIGS. 13A-C may be a fretted, two-tone, tunable tom. FIG. 13A illustrates a top view of another example tunable tom 1300. FIG. 13B illustrates a side view of another example tunable tom 1300. FIG. 12C illustrates a bottom view of another example tunable tom 1300. In particular embodiments, tunable tom 1300 comprises slats 1302A, 1302B, 1303A, 1303B that form a square frame. In particular embodiments, screw 1316A secures a first end of side slat 1302B to a first end of side slat 1303A; screw 1316B secures a second end of side slat 1302B to a first end of side slat 1303B; screw 1316C secures a second end of side slat 1303B to a first end of side slat 1302A; and screw 1316D secures a second end of side slat 1302A to a second end of side slat 1303A.

In particular embodiments, a drum head 1304 is fixed to slats 1303A and 1303B by bars 1306A and 1306B, that are mounted on slats 1303A and 1303B, respectively, mounted securely with one or more screws. In particular embodiments, drum head 1304 covers the entire surface created by the square frame of slats 1302A, 1302B, 1303A, 1303B. In particular embodiments a raised slat 1320 extends between slat 1302A and 1302B, approximately one-third the distance from slat 1303A between slats 1303A and 1303B. In particular embodiments, raised slat 1320 may be in a fixed location, attached to slats 1302A and 1302B. In particular embodiments, raised slat 1320 may be adjustable between a shorter or longer distance from slat 1303A. For example, raised slat 1320 may be a very short distance from slat 1303A, or it may be any distance from slat 1303A until it is approximately half of the distance between slats 1303A and 1303B.

In particular embodiments, raised slat 1320 creates a surface across which drum head 1304 may rest while under tension. In particular embodiments, slat 1320 may be a fret that creates two tones of tunable tom 1300. For example portion 1304A of drum head 1304 may have a higher pitch than portion 1304B of drum head 1304. Depending on the location of raised slat 1320 between slats 1303A and 1303B, portion 1304A and portion 1304B of drum head 1304 may have any combination of varying pitches In particular embodiments, slats 1303A and 1303B are connected by a tuning rod 1308 that lengthens or shortens to lower or raise the respective pitches of portions 1304A, 1304B of drum head 1304 of tunable tom 1300. In particular embodiments, tuning knob 1310 controls the length of tuning rod 1308. In particular embodiments, slats 1302A and 1302B each have a slit 1315A, 1315B respectively, on the end of the slat proximal to slat 1302A, 1302B, respectively. In particular embodiments, each slit 1315A, 1315B guides slat 1303B as tuning rod 1308 lengthens and shortens. As shown in FIG. 12B, in particular embodiments, screw 1316A is attached to to slat 1303A in a fixed position. And screw 1316B is affixed to side slat 1303B through slit 1315B. In particular embodiments, slit 1315B allows slat 1303B to move freely as the length of tuning rod 1308 changes.

Figure 13D:
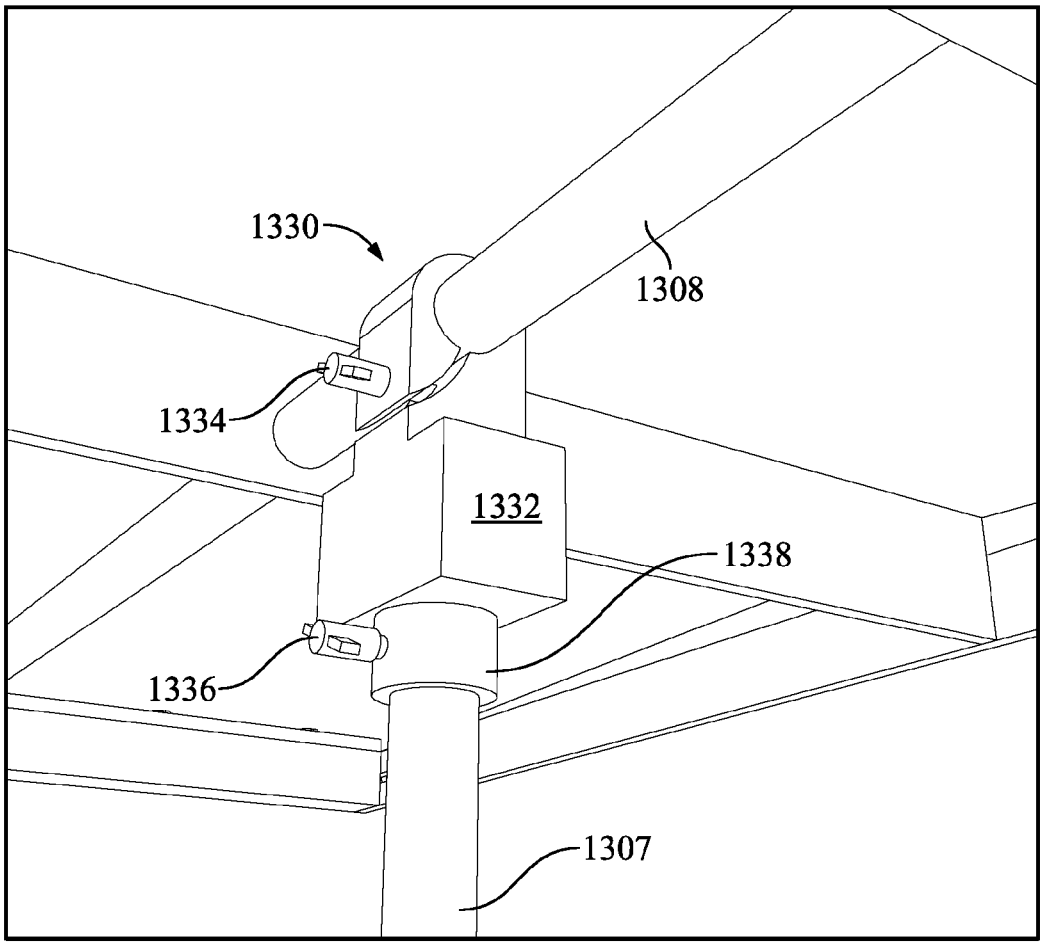
FIG. 13D illustrates a bottom angled perspective view of an example swivel mount.

In particular embodiments, tunable tom 1300 may have a swivel mount 1330. FIGS. 13D-I illustrate different views of an example swivel mount 1330 that may be attached to the another example tom 1300 or any other type of tom. FIG. 13D illustrates a bottom angled view of an example swivel mount 1330 mounted to tuning rod 1308 and component shaft 1307. In particular embodiments, swivel mount 1330 attaches to tuning rod 1308 at any location on turning rod 1308 between slat 1303A and slat 1320, or at any feasible location on tuning rod 1308 between slat 1320 and slat 1303B.

Figure 13E:
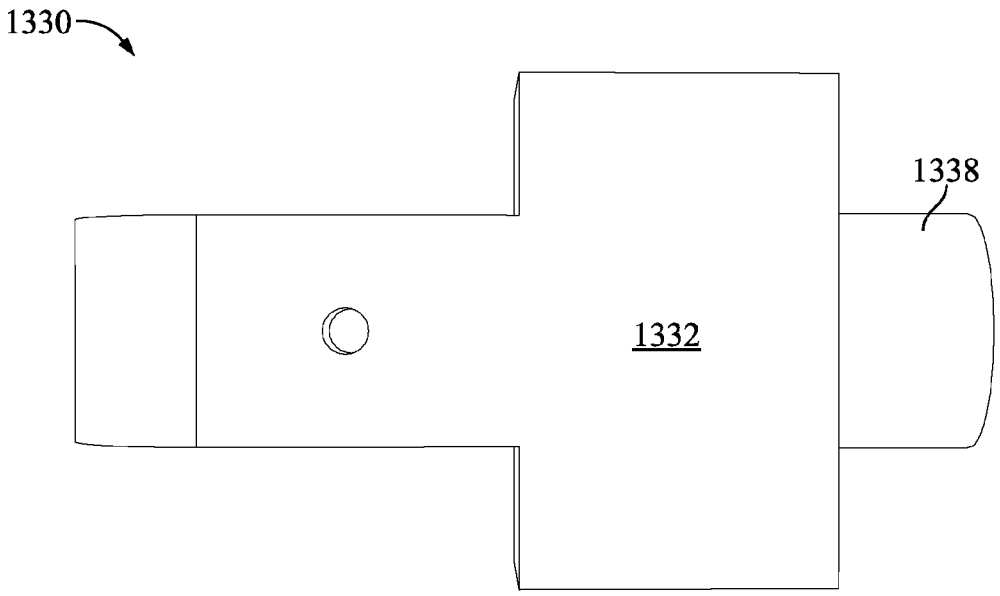
FIG. 13E illustrates a rear view of an example swivel mount.
Figure 13F:
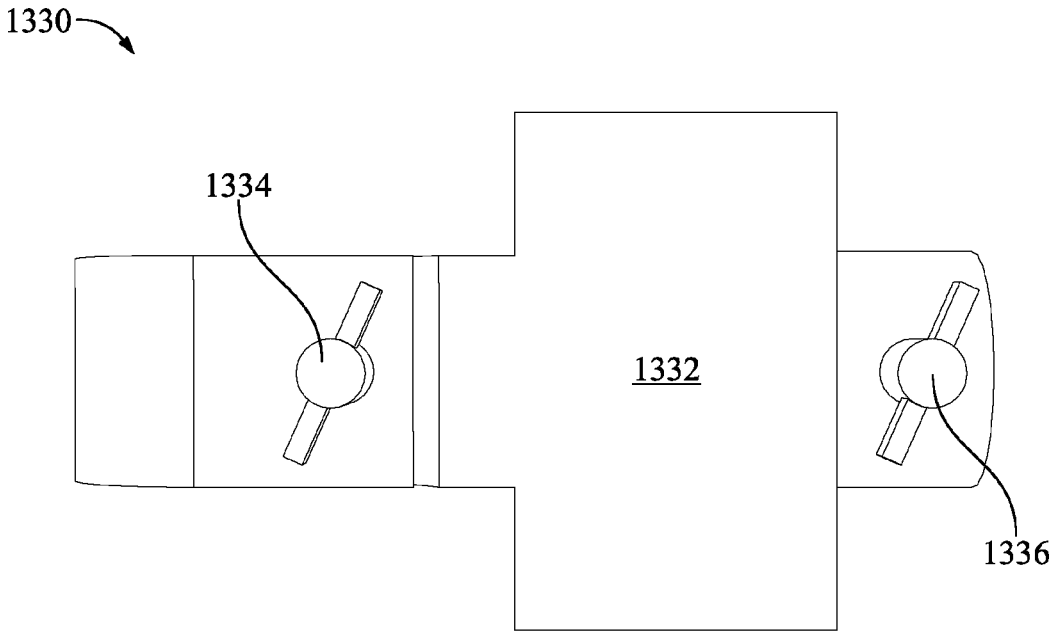
FIG. 13F illustrates a front view of an example swivel mount.
Figure 13G:
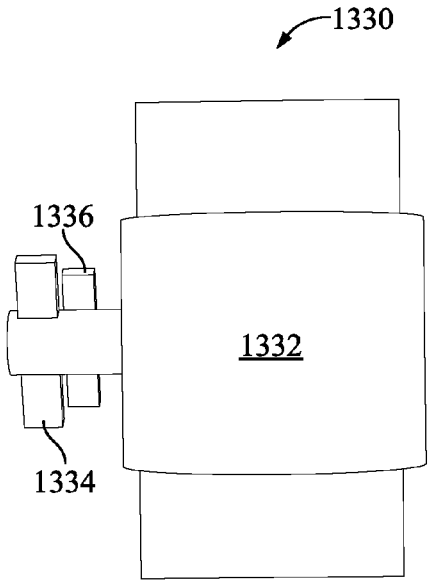
FIG. 13G illustrates a top view of an example swivel mount.
Figure 13H:
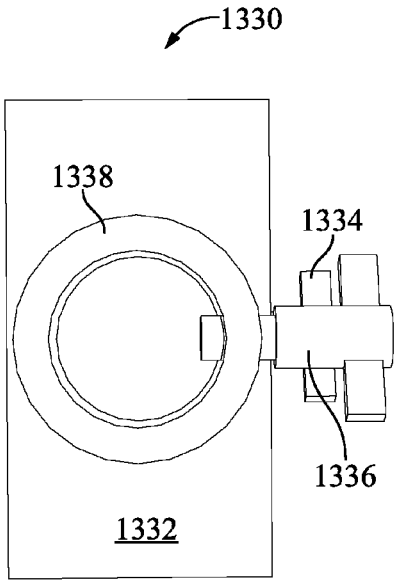
FIG. 13H illustrates a bottom view of an example swivel mount.
Figure 13I:
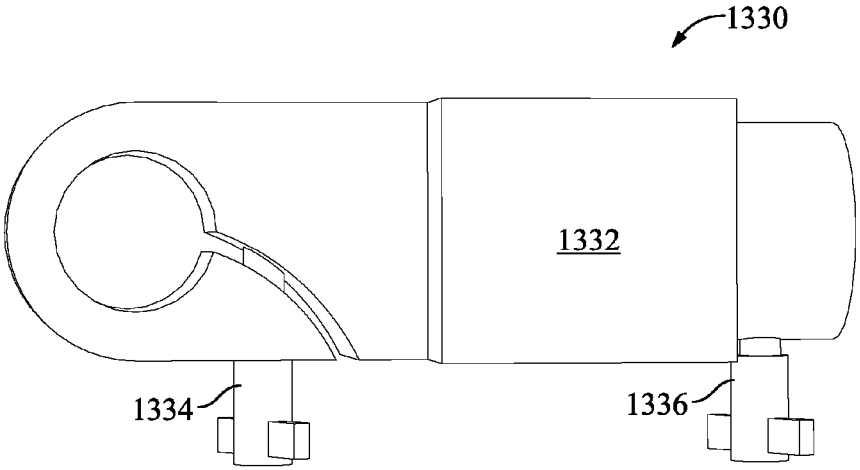
FIG. 13I illustrates a side view of an example swivel mount.

FIG. 13E illustrates a rear view of an example swivel mount 1330. FIG. 13F illustrates a front view of an example swivel mount 1330. FIG. 13G illustrates a top view of an example swivel mount 1330. FIG. 13H illustrates a bottom view of an example swivel mount 1330. FIG. 13I illustrates a side view of example swivel mount 1330. As can be seen in the figures, swivel mount 1330 is comprised of a mounting body 1332 connected to a component shaft mounting body 1338, and clamping screws 1334, 1336. In particular embodiments, mounting body 1332 is shaped so that a portion of mounting body 1332 surrounds a bar to which it is mounted. Mounting body 1332 is secure to the bar to which it is mounted by clamping screw 1334, which tightens or loosens to tighten or loosen the grip pressure of mounting body 1332 on the rod to which it is mounted. In particular embodiments, component shaft mounting body 1338 is shaped to fit over an end of a component shaft. Component shaft mounting body 1338 is held securely to component shaft 1307 by tightening clamping screw 1336. Although component shaft mounting body 1338 is illustrated in the figures generally as a cylinder that fits over an end of a rod, component shaft mounting body could be similarly shaped to mounting body 1332 so that swivel mount 1330 could be mounted on another portion of a component shaft in the same manner in which mounting body 1332 is attached to tuning rod 1308.

Figure 14A:
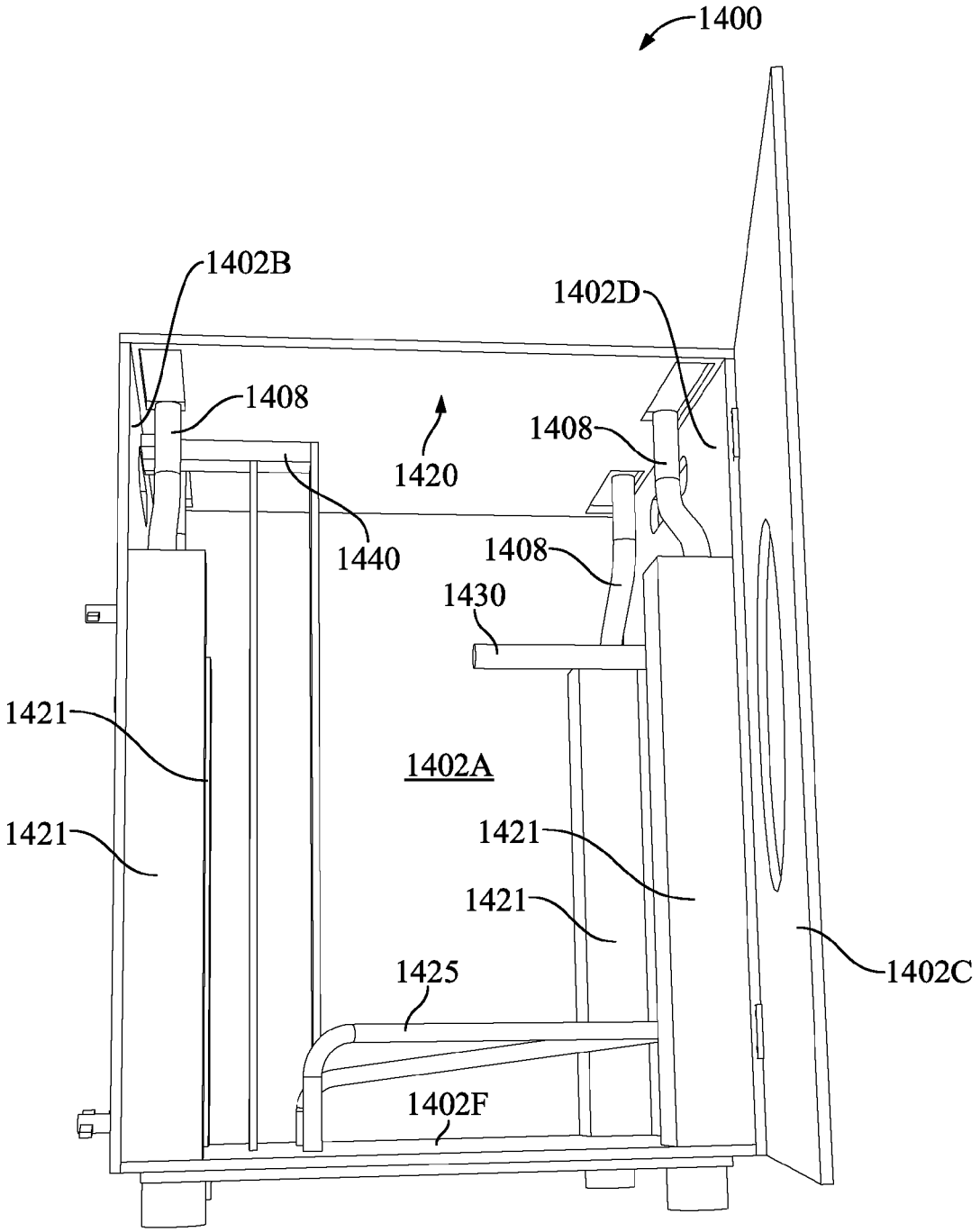
FIG. 14A illustrates an example interior of a go drum without any components present.
Figure 14B:
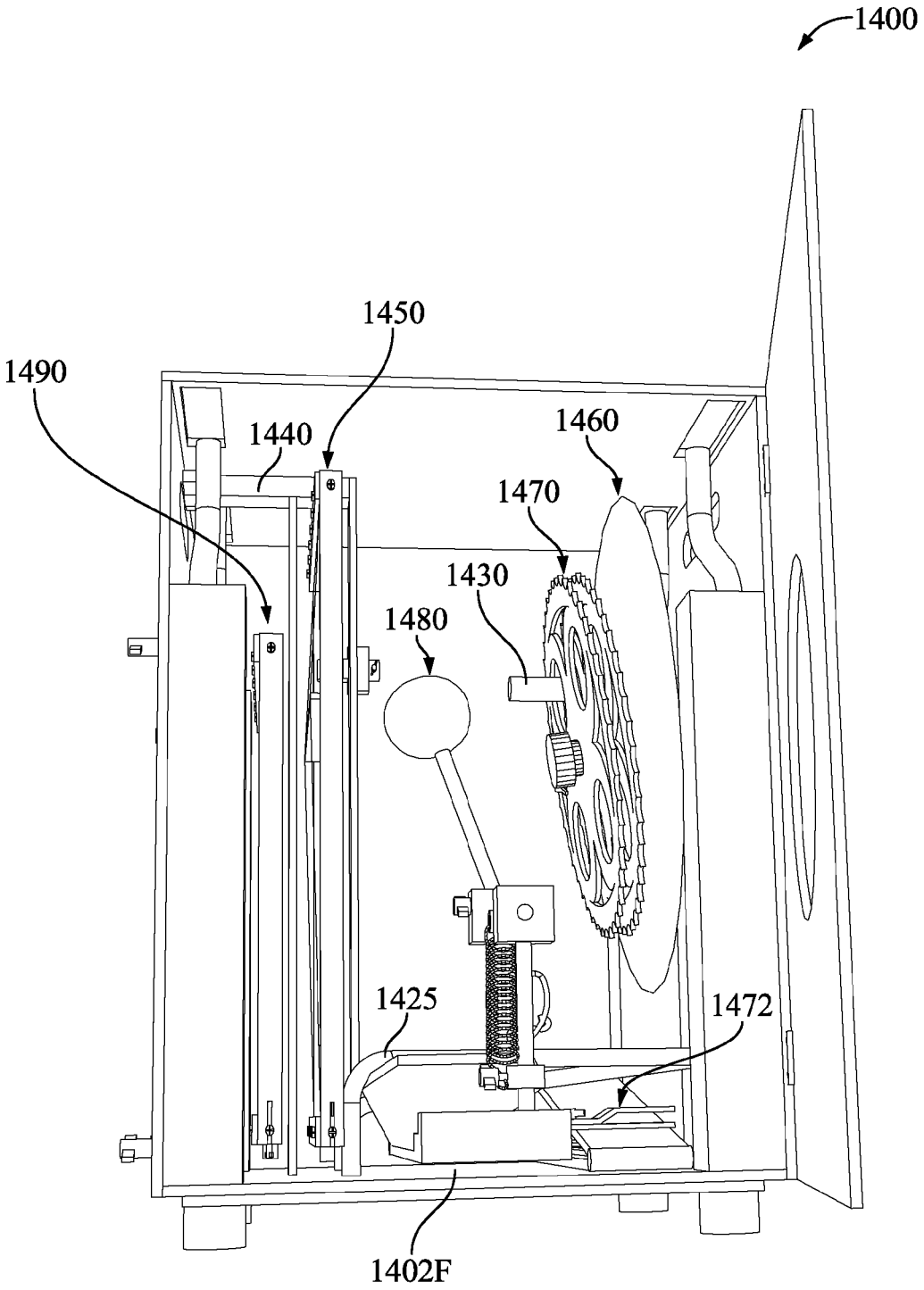
FIG. 14B illustrates an example interior of a go drum with components present.

FIGS. 14A-14B illustrates an example embodiment of a storage structure within an interior of go drum 1400. FIG. 14A illustrates an interior 1420 of a go drum 1400 without any components present. In particular embodiments, body 1402 of FIGS. 14A-B may comprise six sides, including sides 1402A, 1402B, 1402C, 1402D, 1402E, and 1402F. In particular embodiments, side 1402C may open to interior 1420 of body 1402. In particular embodiments, there may be four shaft support cavities 1421 that support component shafts 1408, as shown in FIG. 14A-14B. In particular embodiments, strap 1425 may be permanently attached to side 1402F in two fixed points. In particular embodiments, strap 1425 may reside loosely in interior 1420, not shown in the figures. Or in particular embodiments, strap 1425 may be affixed to side 1402D by being placed around a hook or other attachments means, as shown in the figures. In particular embodiments, strap 1425 secures components 1480 and 1472 by being placed over the components and secured around a hook or other attachment means on side 1402D. In particular embodiments, strap 1425 may be a bungee or other type of elastic strap. In particular embodiments, interior 1420 comprises a horizontal storage rod 1430 that protrudes from side 1402D and is perpendicular to side 1402D. In particular embodiments storage rod 1430 may be used to store hi-hats and cymbals. In particular embodiments, interior 1420 comprises a storage brace 1440 for securing toms or other components. In particular embodiments, storage brace 1440 comprises a horizontal bar and a pair of vertical bars. In particular embodiments, a horizontal bar of storage brace 1440 may be attached to side 1402B and a pair of vertical bars of storage brace 1440 may be attached to side 1402F. In particular embodiments, the horizontal bar of the storage brace 1440 may be comprised of wood, plastic, metal, or another solid material. In particular embodiments, the vertical bars of storage brace 1440 may be comprised of wood, plastic, metal or another solid material.

FIG. 14B illustrates an interior of a go drum 1400 with various components stored within interior 1420 of body 1402. In the example embodiment shown in FIG. 14B, components 1450, 1460, 1470, 1472, 1480, 1490 are stowed in interior 1420 in various fixed locations. In particular embodiments, storage brace 1440 may be used as a tom storage structure, such as storing components 1450 and 1490, which may be variants of a tom. In particular embodiments, horizontal storage rod 1430 may be used to store hi-hats and cymbals, such as for storing component 1460, which may be a cymbal, and for storing component 1470, which may be a hi-hat. In particular embodiments drum kick 1480 and hi-hat pedal 1472 may be secured against side 1402F by strap 1425.

Figure 15:
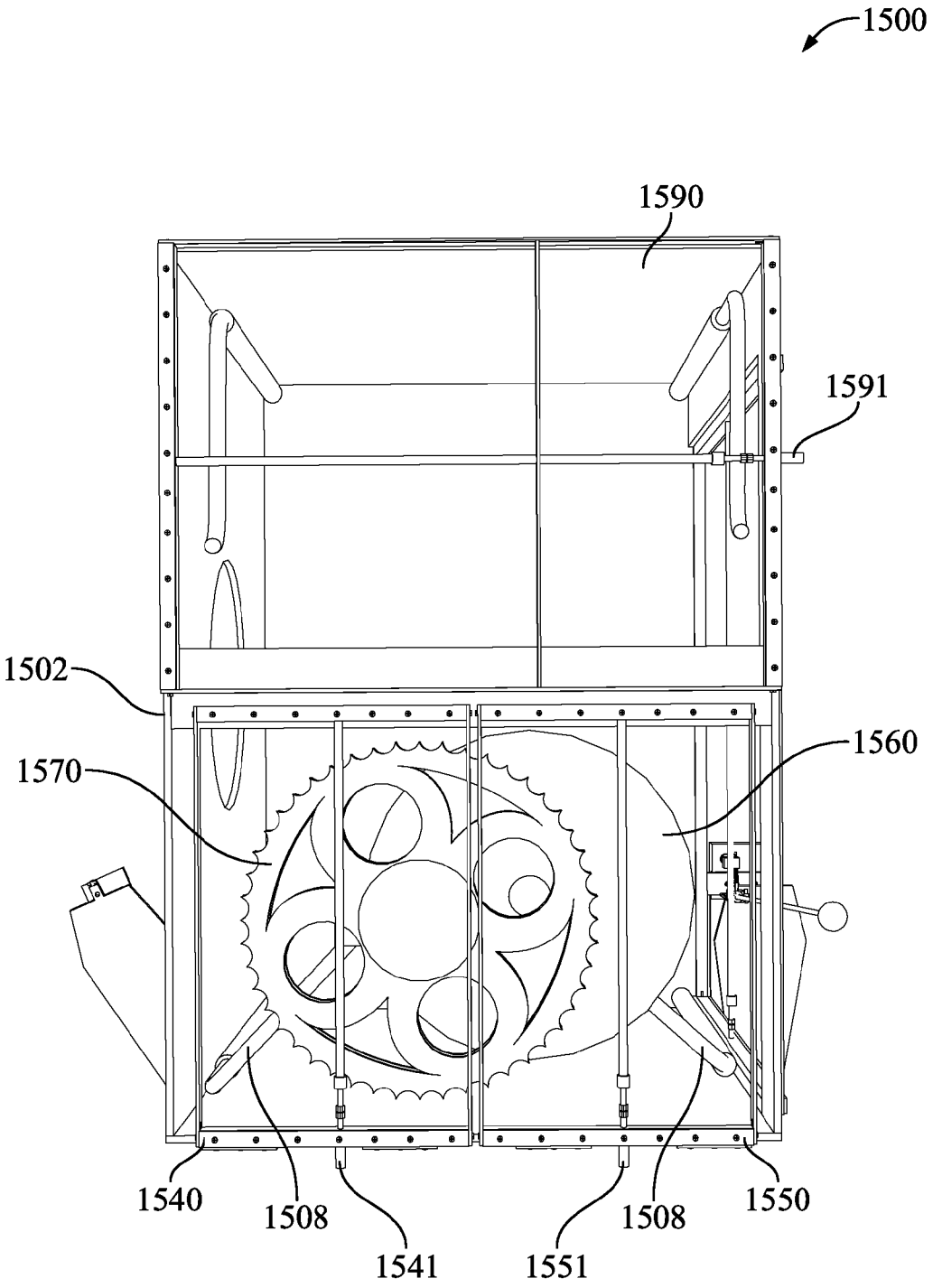
FIG. 15 illustrates a top view of an another example embodiment of a go drum.

FIG. 15 illustrates a top view of a closed example embodiment of a go drum 1500. In the example embodiment of FIG. 15, components 1540, 1550, and 1590 comprise the top side of body 1502 when components 1540, 1550, and 1590 are in a closed position. In particular embodiments, components 1560 and 1570 may be stored in within body 1502. In particular embodiments, component 1540 may be a snare like the snares described elsewhere within this disclosure. In particular embodiments, component 1550 may be a floor tom like the floor toms described elsewhere within this disclosure. In particular embodiments, component 1560 may be a cymbal like the cymbals described elsewhere in this disclosure. In particular embodiments, component 1560 may be loosely stowed within the body 1502. In particular embodiments, component 1560 may be securely attached to component shaft 1508 and stowed within the body 1502. In particular embodiments component 1570 may be a hi-hat like the hi-hats described elsewhere in this disclosure. In particular embodiments, component 1570 may be loosely stowed within the body 1502. In particular embodiments, component 1570 may be securely attached to component shaft 1508 and stowed within the body 1502. In particular embodiments, component 1591 may be a fretted tom. In particular embodiments, components 1540, 1550, and 1590 may be tunable. Component 1540 may have a tuning knob 1541. Component 1550 may have a tuning knob 1551. Component 1590 may have a tuning knob 1591.

Figure 16:
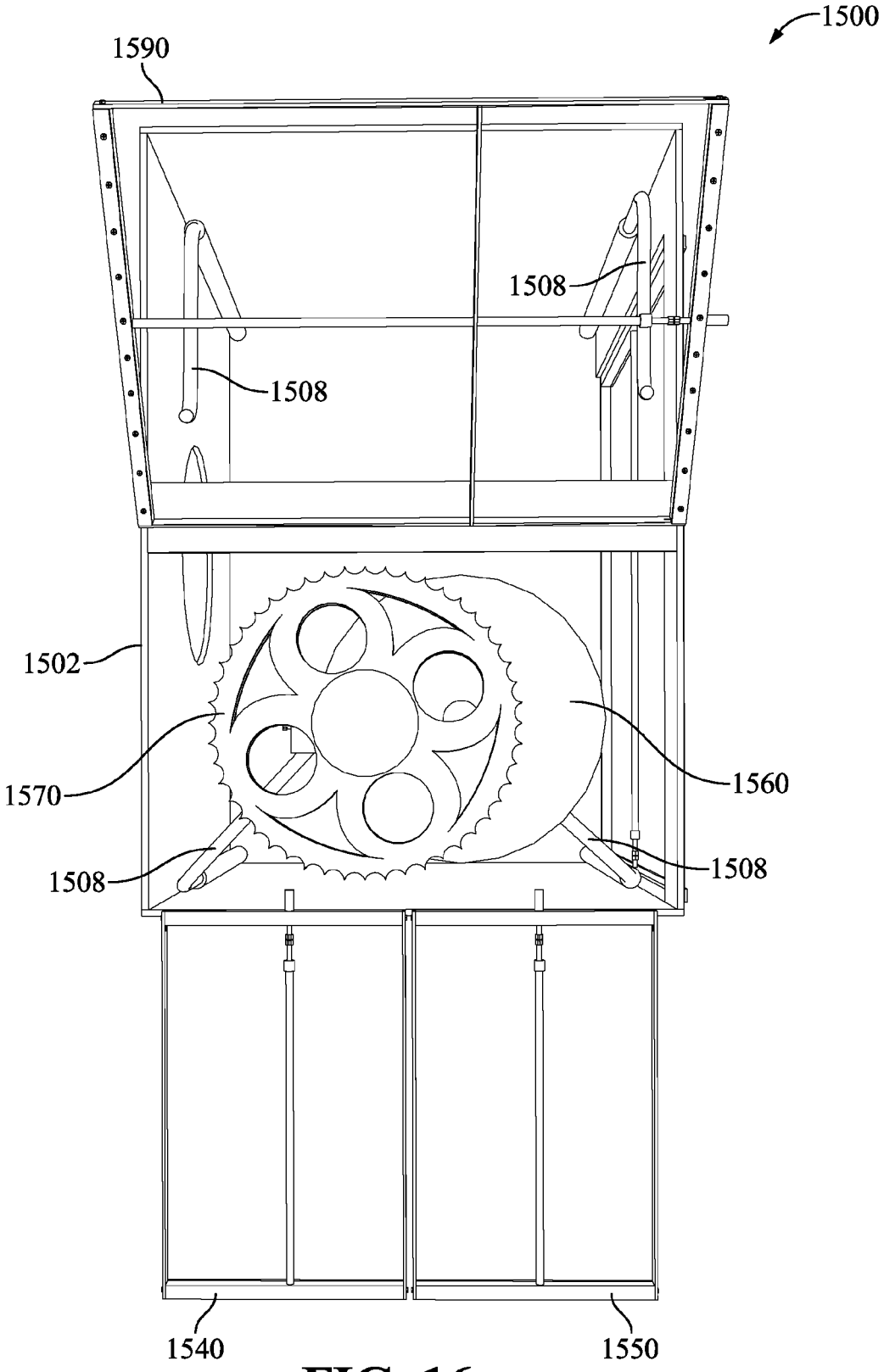
FIG. 16 illustrates another top view of another example embodiment of a go drum.

FIG. 16 illustrates a top view of an open example embodiment of a go drum 1500. In the open example embodiment shown in FIG. 16, components 1540, 1550, and 1590 are connected to body 1502 by hinges (not shown) and open away from body 1502. In particular embodiments, component 1540 and component 1550 are attached to body 1502 by hinges attached to an outer side of body 1502 and open from an angle of 1-180°. In particular embodiments, component 1590 attaches to a centered cross bar of body 1502 by a hinge that allows component 1590 to open, pivoting from the centered cross bar, from an angle of 1-91°. When component 1590 is in a raised position, component shafts 1508 that are below component 1590 may be raised and secured outside of body 1502. In particular embodiments, component 1560 and component 1570 are positioned within body 1502 in a manner that component shafts 1508 attached to component 1560 and component 1570 may be raised out of body 1502.

Figure 17:
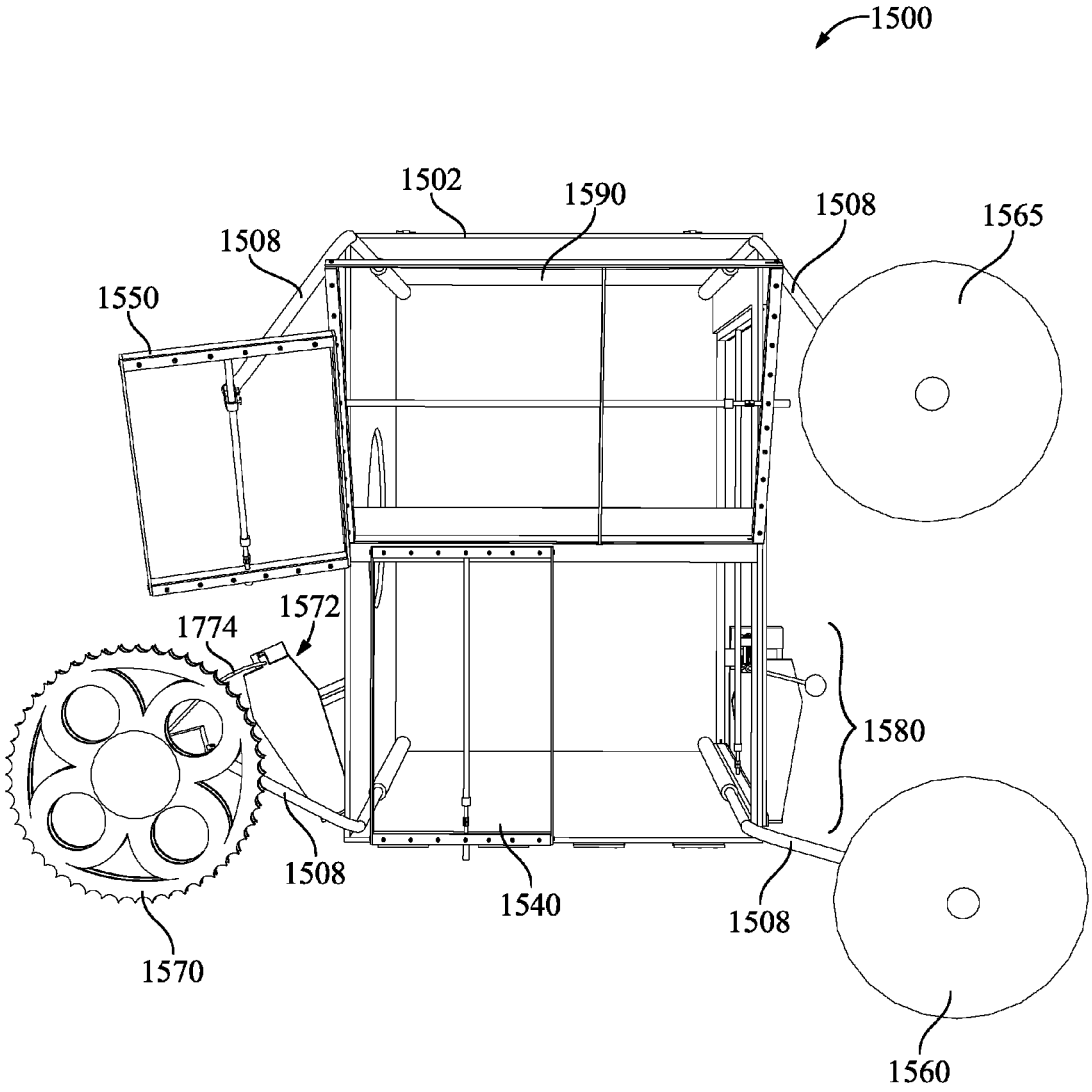
FIG. 17 illustrates a third top view of another example embodiment of a go drum.

FIG. 17 illustrates a top view of an open, assembled and ready to play, embodiment of a go drum 1500. In the open, assembled, and ready to play embodiment of FIG. 17, components 1540, 1550, 1560, 1570, 1580, and 1590 are positioned in a manner that the go drum 1500 is ready to play. Component 1570 is attached to a front left component shaft 1508 and hi-hat pedal 1572 by a pulling connector 1774. Component 1540 is in a closed position on the top of the body 1502. Component 1550 is detached from body 1502 and attached to left rear component shaft 1508. Component 1560 is attached to a front right component shaft 1508. Component 1565 is attached to a rear right component shaft 1508. Component 1580 is placed next to the right side of body 1502. In particular embodiments, component 1590 is in a raised position between 1° and less than 90°. Component shafts 1508 are secured into place by shaft locking mechanisms 1506, shown in FIG. 18.

Figure 18:
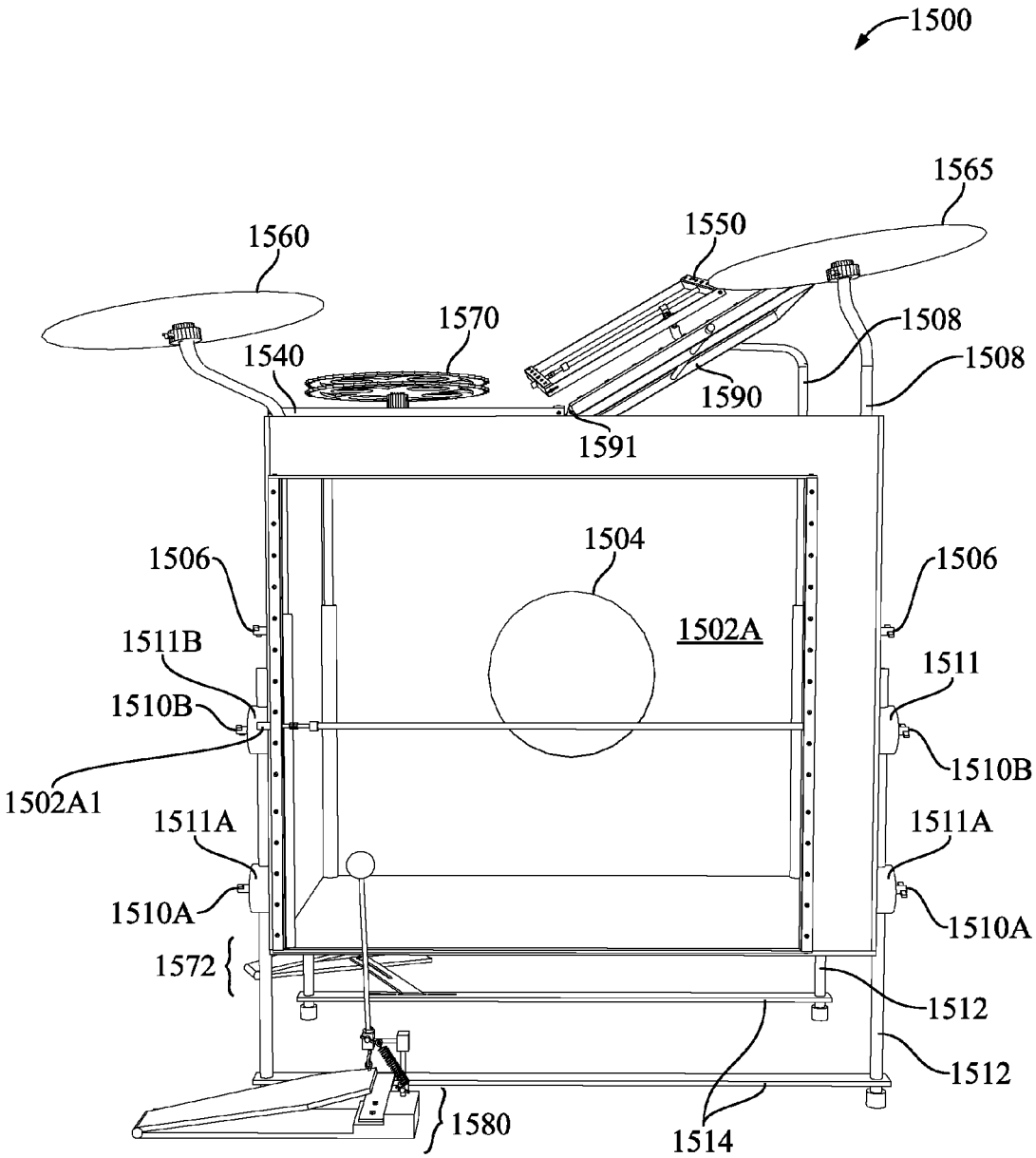
FIG. 18 illustrates a side view of another example embodiment of a go drum.

FIG. 18 illustrates a side view of an open, assembled and ready to play, embodiment of a go drum 1500. In particular embodiments, component 1580 is a drum kick like the drum kicks described elsewhere in the specification. In the embodiment shown in FIG. 18, component 1580 is attached to go drum 1500 by bar 1514 and hi-hat pedal 1572 is attached on the opposite side of body 1502 to another bar 1514. In particular embodiments, component 1580 is positioned to strike side 1502A of body 1502. Side 1502A may be comprised of a material that is the same as the rest of body 1502, or it may be comprised of a material, such as mylar. In particular embodiments, side 1502A may be tunable. In particular embodiments, side 1502A may be tunable and comprised of mylar. In the embodiment shown in FIG. 18, body 1502 is elevated by leg shafts 1512 that are fastened to body 1502. In particular embodiments, leg shafts may be fastened to the outside of body 1502 by outside leg mounts 1511A, 1511B, and secured in a particular position by screws 1510A, 1510B.

Figure 19:
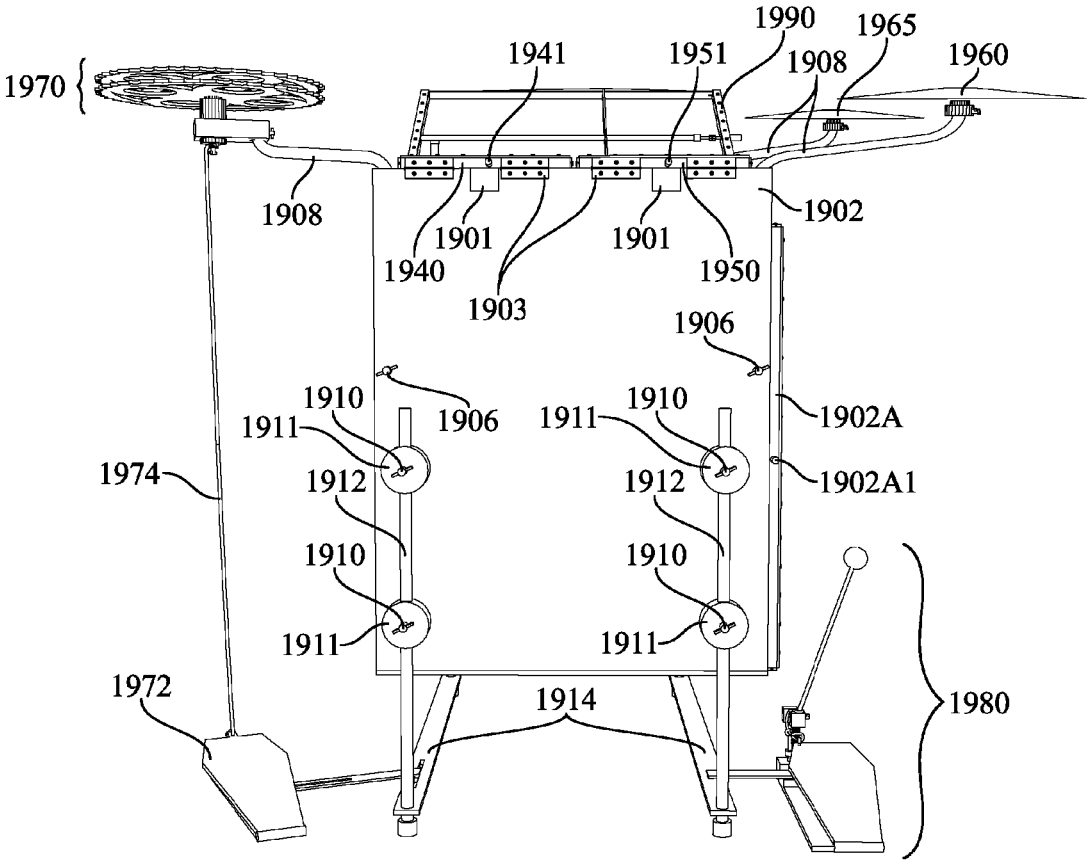
FIG. 19 illustrates another side view of another example embodiment of a go drum.

FIG. 19 illustrates a side view of an open, assembled, another embodiment of a go drum 1900. In particular embodiments, go drum 1900 has a number of components 1940, 1950, 1960, 1965, 1970, 1980, and 1990. In particular embodiments, component 1940 may be a snare with hinges 1903 attaching component 1940 to drum body 1902. In particular embodiments, component 1940 may have a tuning knob 1941. When component 1940 is opened at 1800 from the closed position, knob 1941 passes through hole 1901 in body 1902. In particular embodiments component 1950 may be a floor tom with hinges 1903 attaching component 1950 to drum body 1902. In particular embodiments, component 1940 may have a tuning knob 1951. When component 1950 is open at 1800 from the closed position, knob 1951 passes through hole 1901 in body 1902. In particular embodiments component 1960 and component 1965 may be a cymbal. In particular embodiments, component 1960 and 1965 are attached to component shaft 1908. Component shaft 1908 is fixed into a raised position above the body 1902 and secured by a clamping screw 1906. In particular embodiments, component 1970 may be a hi-hat connected to a hi-hat pedal 1972 via a pulling connector 1974. In particular embodiments, hi-hat pedal 1972 is connected to body 1902 by the bar 1914. In particular embodiments, component 1980 may be a kick pedal that is positioned to strike side 1902A of body 1902. In particular embodiments, side 1902A may be tunable with knob 1902A1. In particular embodiments, component 1980 may be securely connected to go drum 1900 by bar 1914 so that it is a position to be played by a right foot. In particular embodiments, component 1990 may be a fretted tom, such as the fretted toms described above. In particular embodiments, component 1990 may be in a raised position at an angle less than 90°. In particular embodiments, component 1990 is playable in a raised position. In particular embodiments, go drum 1900 is in a raised position on leg shafts 1912. Leg shafts 1912 are secured in a position, through leg mounts 1911, and securely fastened by screws 1910.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This disclosure encompasses all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

The invention claimed is:

1. A compact drum kit comprising:

a body having a hollow interior defined by a top comprising a snare drum, a bottom, three or more sides connecting the top and bottom, and a sound hole;

a plurality of upward extending component mounting shafts mounted in the hollow interior of the body and protruding through a plurality of openings in the body;

a plurality of leg shafts mounted in the hollow interior of the body and protruding through a plurality of openings in the body;

one or more percussion modules that attach to one or more of the plurality of component mounting shafts, wherein each percussion module produces a sound in response to being struck or scraped; and a kick pedal including a beater positioned to strike a first side of the three or more sides and produce a sound.

2. The compact drum kit of claim 1, wherein the hollow interior of the body can store the plurality of component mounting shafts, the plurality of leg shafts, the one or more percussion modules, and the kick pedal.

3. The compact drum kit of claim 1, wherein the body comprises a rectangular cuboid.

4. The compact drum kit of claim 1, wherein the one or more percussion modules are one or more of a tom-tom, a hi-hat cymbals, and a cymbal.

5. A compact drum kit comprising:

a body having a hollow interior defined by a top, a bottom, and three or more sides connecting the top and bottom;

a sound hole;

a plurality of component mounting shafts mounted in the hollow interior of the body and protruding through a plurality of openings in the body;

a plurality of leg shafts mounted in the hollow interior of the body and protruding through a plurality of openings in the body;

one or more percussion modules that attach to one or more of the plurality of component mounting shafts, wherein each percussion module produces a sound in response to being struck or scraped;

a kick pedal including a beater positioned to strike a first side of the three or more sides and produce a sound; and a kickpedal mounting bar attached to and extending between two of the plurality of leg shafts, wherein the kickpedal is mounted to the kickpedal mounting bar in a fixed location.

6. The compact drum kit of claim 1, wherein the plurality of mounting shafts and the plurality of leg shafts are height-adjustable.

* * * * *